US010159294B2

(12) United States Patent
Waters

(10) Patent No.: US 10,159,294 B2
(45) Date of Patent: Dec. 25, 2018

(54) LIGHTED SOLAR HAT

(71) Applicant: Michael Waters, Aspen, CO (US)

(72) Inventor: Michael Waters, Aspen, CO (US)

( * ) Notice: Subject to any disclaimer, the term of this patent is extended or adjusted under 35 U.S.C. 154(b) by 2 days.

(21) Appl. No.: 14/135,240

(22) Filed: Dec. 19, 2013

(65) Prior Publication Data

US 2014/0173807 A1 Jun. 26, 2014

Related U.S. Application Data

(60) Provisional application No. 61/739,587, filed on Dec. 19, 2012, provisional application No. 61/800,156, filed on Mar. 15, 2013.

(51) Int. Cl.
*A42B 1/06* (2006.01)
*A42B 1/24* (2006.01)

(52) U.S. Cl.
CPC ..... *A42B 1/242* (2013.01); *A42B 1/244* (2013.01)

(58) Field of Classification Search
CPC ..... A42B 1/242; A42B 1/244; A42B 1/24; A42B 3/0433; A42B 3/044; A42B 1/245; A42B 1/008; A42B 1/248; A43B 3/0078; A41D 19/0024; A41D 19/0027
USPC ..... 2/209.12, 209.13, 209.14, 195.1; 362/105, 106
See application file for complete search history.

(56) References Cited

U.S. PATENT DOCUMENTS 645,984 A 3/1900 Tournier
909,742 A 1/1909 Borchert
1,098,628 A 6/1914 Hyman
1,109,415 A 9/1914 Harris
1,261,824 A 1/1918 La Vine
1,255,265 A 2/1918 Zachara
1,323,822 A 12/1919 Bramming
D58,302 S 7/1921 Bartholomew
1,438,586 A 12/1922 Eaton
1,448,353 A 3/1923 Barany
(Continued)

FOREIGN PATENT DOCUMENTS

AU 1178576 9/1977
AU 6310994 11/1994
(Continued)

OTHER PUBLICATIONS

'Initial Non-Infringement, Invalidity and Unenforceability, Contentions' with Exhibit A, Exhibits B-1 and B-2, and Exhibits C-1 through C7, *Waters Industries, Inc.* v. *Outdoor Cap Co., Inc.*, United States District Court for the Northern District of Illinois, Case No. 1:13-cv-07191, 263 pages (Dec. 18, 2013).
(Continued)

*Primary Examiner* — Jameson Collier
*Assistant Examiner* — Heather Mangine
(74) *Attorney, Agent, or Firm* — Fitch, Even, Tabin & Flannery LLP

(57) ABSTRACT

Headgear as provided herein includes a light source for providing light away therefrom, a rechargeable battery for providing power to the light source, and a solar panel for recharging the rechargeable battery mounted thereto. The headgear can include a housing configured to at least partially receive the light source, the solar panel, and the rechargeable battery therein. The housing is configured to mount to the hat and orient the electronic components in desired configurations.

8 Claims, 12 Drawing Sheets

(56) References Cited

U.S. PATENT DOCUMENTS 1,475,653 A 11/1923 Rosenberg
1,572,210 A 2/1926 Kolibas
1,615,067 A 1/1927 Boerman
1,744,777 A 1/1930 Lundgren
1,749,998 A 3/1930 Collins
1,879,512 A 9/1932 Rotea
1,883,756 A 10/1932 Bloom
D114,980 S 1/1939 Wengen
2,196,543 A 4/1940 Anderson
2,373,553 A 10/1942 Fetterman
D137,375 S 2/1944 Heit
2,369,829 A 2/1945 Johnson
2,461,254 A 2/1949 Bassett
2,473,394 A 6/1949 Scott
2,531,585 A 11/1950 Pope
2,540,435 A 2/1951 Ferguson
2,552,764 A 5/1951 Bedford, Jr.
2,567,046 A 9/1951 Anderson
2,591,112 A 4/1952 Zwierzynski
2,638,532 A 5/1953 Brady
2,640,980 A 6/1953 Prupis
2,705,751 A 4/1955 Harris
2,730,720 A 1/1956 Saunders
2,788,439 A 4/1957 Hesse
2,904,670 A 9/1959 Calmes
2,966,580 A 12/1960 Taylor
2,978,696 A 4/1961 Keller
3,008,040 A 11/1961 Moore
3,032,647 A 5/1962 Wansky
3,040,881 A 6/1962 McNeill
3,057,992 A 10/1962 Baker
3,060,308 A 10/1962 Fortuna
3,123,208 A 3/1964 Barnum
3,184,058 A 5/1965 Crowther
3,201,771 A 8/1965 Proulx
D207,919 S 6/1967 Fai
3,350,552 A 10/1967 Lawrence
3,358,137 A 12/1967 Sinclair
3,447,164 A 6/1969 Greenhouse
D215,751 S 10/1969 Castellano
3,491,374 A 1/1970 Frangos
3,535,282 A 10/1970 Mallory
3,537,909 A 11/1970 Horton
3,602,759 A 8/1971 Evans
3,634,676 A 1/1972 Castellano
3,647,059 A 3/1972 Humphreys
3,666,901 A 5/1972 Weinhart
3,683,168 A 8/1972 Tatje
3,749,902 A 7/1973 Drew
3,769,663 A 11/1973 Perl
D229,975 S 1/1974 Klugmann
3,793,517 A 2/1974 Carlini
3,845,389 A 10/1974 Phillips
3,947,676 A 3/1976 Battilana
3,963,917 A 6/1976 Romano
4,005,776 A 2/1977 Seeley
4,011,600 A 3/1977 Malk
4,053,688 A 10/1977 Perkins
4,092,704 A 5/1978 Malm
4,176,932 A 12/1979 Young
4,186,429 A 1/1980 Johnston
4,210,952 A 7/1980 Ressmeyer
4,231,079 A 10/1980 Heminover
4,254,451 A 3/1981 Cochran
4,268,894 A 5/1981 Bartunek
4,270,227 A * 6/1981 Wolfe ..... A43B 7/08 2/87
4,283,127 A 8/1981 Rosenwinkel
4,298,913 A 11/1981 Lozar
4,317,162 A 2/1982 Richards
4,332,007 A 5/1982 Gibstein
4,364,107 A 12/1982 Wieczorek
4,392,183 A 7/1983 Ostlund
4,398,237 A 8/1983 Doyel
4,406,040 A 9/1983 Cannone
4,425,531 A 1/1984 Holmes
D272,733 S 2/1984 Cosmos
4,430,532 A 2/1984 Matsumoto
4,442,478 A 4/1984 Stansbury
4,462,064 A 7/1984 Schweitzer
4,470,263 A 9/1984 Lehovec
4,483,021 A 11/1984 McCall
4,516,157 A 5/1985 Campbell
4,521,831 A 6/1985 Thayer
4,541,698 A 9/1985 Lerner
4,551,857 A 11/1985 Galvin
4,553,851 A * 11/1985 Matsumoto ..... G04C 3/008 368/203
4,559,516 A 12/1985 Schott
4,570,206 A 2/1986 Deutsch
4,602,191 A 7/1986 Davila
4,604,760 A 8/1986 Coin
4,616,297 A 10/1986 Liu
4,631,644 A 12/1986 Dannhauer
4,638,410 A 1/1987 Barker
4,641,647 A 2/1987 Behan
4,642,817 A 2/1987 Ferstenfeld
4,665,568 A 5/1987 Stutes
4,667,274 A * 5/1987 Daniel ..... F21L 11/00 2/209.13
4,669,610 A 6/1987 Lindsey
4,680,815 A 7/1987 Hirsch
4,774,643 A 9/1988 McGinnis
4,794,496 A 12/1988 Lanes
4,817,212 A 4/1989 Benoit
4,822,160 A 4/1989 Tsai
4,822,161 A 4/1989 Jimmy
4,827,384 A 5/1989 VonSchlemmer
4,829,285 A 5/1989 Brand
4,872,218 A 10/1989 Holt
4,875,147 A 10/1989 Auer
4,884,067 A 11/1989 Nordholm
4,901,210 A 2/1990 Hanabusa
4,901,211 A 2/1990 Shen
4,902,119 A 2/1990 Porsche
4,904,078 A 2/1990 Gorike
4,920,466 A 4/1990 Liu
4,945,458 A 7/1990 Batts
4,951,068 A 8/1990 Ichikawa
4,959,760 A 9/1990 Wu
4,963,045 A 10/1990 Willcox
4,969,069 A 11/1990 Eichost
4,991,068 A 2/1991 Mickey
4,998,187 A 3/1991 Herrick
5,003,640 A 4/1991 Pizzacar
D316,932 S 5/1991 Escher, Jr.
5,039,829 A 8/1991 Brucksch
5,060,814 A 10/1991 Oglesbee
5,068,771 A 11/1991 Savage, Jr.
5,070,436 A 12/1991 Alexander
5,088,127 A 2/1992 Thornock
5,111,366 A 5/1992 Rife
5,113,325 A 5/1992 Eisenbraun
5,117,510 A 6/1992 Broussard
5,122,943 A 6/1992 Pugh
5,138,538 A 8/1992 Sperling
5,140,116 A 8/1992 Schmitt-Walter
5,140,220 A 8/1992 Hasegawa
5,143,443 A 9/1992 Madsen
5,158,356 A 10/1992 Guthrie
5,163,420 A 11/1992 VanDerBel
5,164,749 A 11/1992 Shelton
5,165,789 A 11/1992 Womack
5,183,326 A 2/1993 Case
5,189,512 A 2/1993 Cameron
5,193,220 A 3/1993 Ichinohe
5,193,347 A 3/1993 Apisdorf
5,207,500 A 5/1993 Rios
5,218,385 A 6/1993 Lii
5,224,772 A 7/1993 Fustos
5,230,558 A 7/1993 Jong
5,238,344 A 8/1993 Nagayama
5,245,516 A 9/1993 deHaas
5,249,675 A 10/1993 Strauss

(56) References Cited

U.S. PATENT DOCUMENTS

D343,470 S 1/1994 Yuen
5,278,734 A 1/1994 Ferber
D349,123 S 7/1994 Cooley
5,329,637 A 7/1994 Walker
5,331,333 A 7/1994 Tagawa
5,331,357 A 7/1994 Cooley
5,353,205 A 10/1994 Hudak
5,357,409 A 10/1994 Glatt
5,363,291 A 11/1994 Steiner
5,367,345 A 11/1994 da Silva
5,404,593 A 4/1995 Kronenberger
5,408,393 A 4/1995 Becker
5,410,746 A 4/1995 Gelber
5,412,545 A 5/1995 Rising
5,418,565 A 5/1995 Smith
5,423,419 A 6/1995 Wentz
5,425,620 A * 6/1995 Stroud ..... A42B 1/008 2/171.3
5,438,698 A 8/1995 Burton
5,452,190 A 9/1995 Priesemuth
5,460,346 A 10/1995 Hirsch
5,463,538 A 10/1995 Womack
5,467,992 A 11/1995 Harkness
5,485,358 A 1/1996 Chien
5,488,361 A 1/1996 Perry
5,503,637 A 4/1996 Kyricos
5,508,900 A 4/1996 Norman
5,510,961 A 4/1996 Peng
5,541,767 A 7/1996 Murphy
5,541,816 A 7/1996 Miserendino
5,542,627 A 8/1996 Crenshaw
5,546,099 A 8/1996 Quint
5,564,128 A 10/1996 Richardson
5,567,038 A 10/1996 Lary
D375,372 S 11/1996 Allen
5,575,554 A 11/1996 Guritz
5,601,358 A 2/1997 Chien
5,606,743 A 2/1997 Vogt
5,608,808 A 3/1997 da Silva
5,610,678 A 3/1997 Tsuboi
5,644,189 A 7/1997 Busby
5,655,374 A 8/1997 Santilli
D383,754 S 9/1997 Yuen
D383,863 S 9/1997 Yuen
5,667,291 A 9/1997 Caplan
5,667,292 A 9/1997 Sabalvaro, Jr.
5,676,449 A 10/1997 Newsome
5,677,079 A 10/1997 DeZorzi
5,680,718 A 10/1997 Ratcliffe
5,688,039 A 11/1997 Johnson
D388,113 S 12/1997 Feinbloom
5,692,244 A 12/1997 Johnson
5,708,449 A 1/1998 Heacock
5,709,464 A 1/1998 Tseng
5,718,335 A 2/1998 Boudreaux
5,722,762 A 3/1998 Soll
5,730,290 A 3/1998 Futo
5,741,060 A 4/1998 Johnson
5,743,621 A 4/1998 Mantha
5,758,947 A 6/1998 Glatt
5,774,338 A 6/1998 Wessling, III
5,786,665 A 7/1998 Ohtsuki
5,800,278 A 9/1998 Varriano
5,806,961 A 9/1998 Dalton
5,822,636 A 10/1998 Cho
5,829,063 A 11/1998 Cheng
5,829,860 A 11/1998 Lawther
5,836,673 A 11/1998 Lo
5,845,778 A 12/1998 Hickey, Jr.
5,845,987 A 12/1998 Painter
5,857,220 A 1/1999 Erny
5,865,333 A 2/1999 Wolfe
5,871,271 A 2/1999 Chien
D407,187 S 3/1999 Makki
5,876,241 A 3/1999 Frantz
5,893,631 A 4/1999 Padden
5,894,604 A 4/1999 Crabb
5,918,966 A 7/1999 Arnold
5,920,910 A 7/1999 Calvo
5,921,674 A 7/1999 Koczi
5,922,489 A 7/1999 Adachi
5,931,693 A 8/1999 Yamazaki
5,946,071 A 8/1999 Feldman
5,982,969 A 11/1999 Sugiyama
5,997,165 A 12/1999 Lehrer
6,005,536 A 12/1999 Beadles
6,007,212 A 12/1999 Chan
6,007,213 A 12/1999 Baumgartner
6,009,563 A 1/2000 Swanson
6,012,822 A 1/2000 Robinson
6,012,827 A 1/2000 Caplan
D420,035 S 2/2000 Hartman
D420,207 S 2/2000 Barton
6,021,525 A 2/2000 Mertins
6,023,788 A 2/2000 McCallum
6,028,627 A 2/2000 Helmsderfer
6,032,291 A 3/2000 Asenguah
6,032,293 A 3/2000 Makki
6,056,413 A 5/2000 Urso
D428,431 S 7/2000 Jordan
6,086,214 A 7/2000 Ridge
6,087,037 A 7/2000 Rieder
6,088,053 A 7/2000 Hammack
6,094,749 A 8/2000 Proctor
6,113,243 A 9/2000 Saul
6,113,244 A 9/2000 Baumgartner
6,116,745 A 9/2000 Yei
6,124,056 A 9/2000 Kimura
6,126,294 A 10/2000 Koyama
6,167,570 B1 1/2001 Su
6,168,286 B1 1/2001 Duffy
6,172,657 B1 1/2001 Kamakura
6,174,075 B1 1/2001 Fuwausa
6,176,601 B1 1/2001 Nester
6,206,543 B1 3/2001 Henry
6,236,007 B1 5/2001 Ho
6,237,147 B1 5/2001 Brockman
6,240,566 B1 6/2001 Scantlin
6,244,721 B1 6/2001 Rodriguez
6,250,769 B1 6/2001 Kirk
D445,928 S 7/2001 Sharrah
6,256,795 B1 7/2001 Habel
D446,324 S 8/2001 Lynch
6,290,368 B1 9/2001 Lehrer
6,299,323 B1 10/2001 Yu
6,302,570 B1 10/2001 Petell
6,306,538 B1 10/2001 Saitoh
6,307,526 B1 10/2001 Mann
6,311,350 B1 11/2001 Kaiserman
6,311,837 B1 11/2001 Blaustein
6,320,822 B1 11/2001 Okeya
6,325,521 B1 12/2001 Gregg
6,328,454 B1 12/2001 Davis
6,340,234 B1 1/2002 Brown, Jr.
6,345,716 B1 2/2002 Chapman
6,347,410 B1 2/2002 Lee
6,363,537 B1 4/2002 Park
6,366,344 B1 4/2002 Lach
6,367,949 B1 4/2002 Pederson
D457,670 S 5/2002 Allen
6,382,407 B1 5/2002 Chao
6,386,701 B1 5/2002 Khulusi
6,390,640 B1 5/2002 Wong
6,398,386 B1 6/2002 Huang
6,416,199 B1 7/2002 Heine
6,431,904 B1 8/2002 Berelsman
6,439,738 B1 8/2002 Matthews
6,442,764 B1 9/2002 Badillo
6,457,838 B1 10/2002 Dugmore
6,461,015 B1 10/2002 Welch
6,461,025 B1 10/2002 Payne
6,474,830 B1 11/2002 Hansen
6,476,391 B1 11/2002 Zhang
6,497,493 B1 12/2002 Theisen

(56) References Cited

U.S. PATENT DOCUMENTS

D469,198 S 1/2003 Olson
6,504,099 B2 1/2003 Huang
6,523,973 B2 2/2003 Galli
6,530,672 B2 3/2003 Galli
6,538,567 B2 3/2003 Stewart
D473,890 S 4/2003 Waters
6,549,231 B1 4/2003 Matsui
6,553,570 B1 4/2003 Flynn
6,554,444 B2 4/2003 Shimada
6,578,982 B1 6/2003 Lynch
D477,432 S 7/2003 Parsons
6,598,991 B2 7/2003 Altman
6,604,837 B2 8/2003 Sandberg
6,612,695 B2 9/2003 Waters
6,612,696 B2 9/2003 Waters
6,616,293 B2 9/2003 Mickey
6,634,031 B1 10/2003 Schlapkohl
6,642,667 B2 11/2003 Avis
D483,928 S 12/2003 Mansell
6,659,618 B2 12/2003 Waters
D484,905 S 1/2004 Waters
6,679,615 B2 1/2004 Spearing
6,704,044 B1 3/2004 Foster
6,709,142 B2 3/2004 Gyori
6,713,956 B2 3/2004 HsingChen
6,715,309 B1 4/2004 Junkins
6,719,437 B2 4/2004 Lary
6,721,962 B1 4/2004 Polaire
D489,165 S 5/2004 Waters
6,733,150 B1 5/2004 Hanley
6,749,166 B2 6/2004 Valentine
6,760,925 B1 7/2004 Maxwell
6,764,194 B1 7/2004 Cooper
6,802,636 B1 10/2004 Bailey, Jr.
6,808,284 B1 10/2004 Chao
6,811,441 B2 11/2004 Simpson
6,817,711 B2 11/2004 Schubert
6,830,357 B2 12/2004 Lopez
D501,266 S 1/2005 Harris
6,837,590 B2 1/2005 Marston
6,857,739 B1 2/2005 Watson
6,860,628 B2 3/2005 Robertson
6,863,416 B2 3/2005 Waters
6,865,285 B1 3/2005 Villa-Aleman
6,880,989 B2 4/2005 Sotome
6,908,208 B1 6/2005 Hyde
D507,368 S 7/2005 Waters
D507,369 S 7/2005 Waters
6,918,678 B2 7/2005 McClanahan
6,923,322 B2 8/2005 Lenker
6,929,375 B2 8/2005 Satomi
6,929,878 B2 8/2005 Chen
6,932,216 B2 8/2005 Blaustein
6,935,761 B2 8/2005 Vanderschuit
6,941,583 B2 9/2005 Yan
6,966,668 B2 11/2005 Cugini
6,969,178 B2 11/2005 Zuloff
6,977,776 B2 12/2005 Volkenandt
6,993,803 B2 2/2006 Chan
6,994,445 B1 2/2006 Pomes
6,997,552 B1 2/2006 Hung
7,000,841 B2 2/2006 Becker
7,003,353 B1 2/2006 Parkhouse
7,004,439 B1 2/2006 Taylor
7,004,582 B2 2/2006 Jannard
7,008,074 B1 3/2006 Halm
7,021,790 B2 4/2006 Parsons
D520,460 S 5/2006 Wadsworth
7,052,154 B2 5/2006 Vanderschuit
7,055,179 B2 6/2006 Warner
7,086,749 B1 8/2006 Hanley
7,094,981 B2 8/2006 Sorrentino
7,104,670 B2 9/2006 Waters
7,105,939 B2 9/2006 Bednyak
7,111,956 B2 9/2006 Brown
7,114,823 B2 10/2006 McCullough
7,118,241 B2 10/2006 Sohn
7,118,262 B2 10/2006 Negley
7,128,434 B1 10/2006 Nally
7,143,451 B2 * 12/2006 Lundgren ..... A42C 5/04 2/171.3
7,147,324 B2 12/2006 Jannard
7,147,338 B2 12/2006 Gregg
7,150,526 B2 12/2006 Jannard
7,163,309 B2 1/2007 Sohn
7,182,478 B2 2/2007 Marston
7,186,159 B1 3/2007 Baxter
7,192,151 B2 3/2007 Clupper
7,209,652 B2 4/2007 Uenaka
7,213,917 B2 5/2007 Jannard
7,216,973 B2 5/2007 Jannard
7,234,831 B1 6/2007 Hanley
7,226,180 B2 7/2007 Sung
7,255,437 B2 8/2007 Howell
7,264,350 B2 9/2007 Jannard
D553,177 S 10/2007 Chen
7,278,734 B2 10/2007 Jannard
7,281,826 B2 10/2007 Huang
7,318,654 B2 1/2008 McClanahan
7,331,064 B1 * 2/2008 Quintal ..... A42B 1/008 2/171.3
D566,044 S 4/2008 DArco
D568,922 S 5/2008 Anderl
7,369,174 B2 5/2008 Olita
7,377,664 B2 5/2008 Waters
7,427,149 B2 9/2008 Sohn
7,431,472 B2 10/2008 Becker
7,438,409 B2 10/2008 Jordan
7,457,536 B2 11/2008 Hamada
7,461,764 B2 12/2008 Thompson
7,466,040 B2 12/2008 Bruwer
7,470,022 B2 12/2008 Lerner
7,506,992 B2 3/2009 Carter
D591,675 S 5/2009 Waters
7,562,979 B2 7/2009 Waters
7,576,800 B2 8/2009 Swain
D600,208 S 9/2009 Waters
D600,738 S 9/2009 Su
7,598,928 B1 10/2009 Buskop
7,607,775 B2 10/2009 Hermanson
7,609,295 B2 10/2009 Aridome
7,611,255 B1 11/2009 Lagassey
7,621,000 B1 11/2009 Fulton
D605,381 S 12/2009 Mastrantonio
7,661,818 B2 2/2010 Waters
D611,086 S 3/2010 Meng-Suen
7,677,751 B2 3/2010 Kinsman
7,699,486 B1 4/2010 Beiner
D617,826 S 6/2010 Waters
7,753,547 B2 7/2010 Waters
7,755,219 B2 7/2010 Bruwer
7,784,960 B2 8/2010 Lahtinen
7,862,979 B2 1/2011 Waters
7,934,846 B1 5/2011 Schwanz
7,938,553 B1 5/2011 Beiner
7,942,543 B2 5/2011 Ritter
8,002,437 B2 8/2011 Sohn
8,075,153 B2 12/2011 Werner
8,141,395 B2 3/2012 Dillavou
8,157,403 B2 4/2012 Lau
D659,351 S 5/2012 Benkendorfer
8,333,485 B2 12/2012 Waters
8,364,220 B2 1/2013 Sandmore
8,388,164 B2 3/2013 Waters
8,491,145 B2 7/2013 Waters
8,550,651 B2 10/2013 Waters
8,698,027 B2 4/2014 Anderst
8,757,931 B2 6/2014 Puttmann
8,769,723 B1 7/2014 Ilges
8,774,420 B2 7/2014 Belafonte
8,813,268 B1 8/2014 Fitzgerald
8,919,984 B1 12/2014 Fitzgerald
8,950,012 B2 2/2015 Ilges
9,057,500 B2 6/2015 Opolka

(56) References Cited

U.S. PATENT DOCUMENTS

D734,925 S 7/2015 Waters
9,101,174 B2 8/2015 Waters
2001/0024365 A1 9/2001 Aknine
2002/0027777 A1 3/2002 Takasu
2002/0129989 A1 9/2002 Parsons
2002/0131275 A1 9/2002 Yamamoto
2002/0159250 A1 10/2002 Kuo
2002/0187806 A1 12/2002 Jang
2003/0079387 A1 5/2003 Derose
2003/0106918 A1 6/2003 Hung
2003/0169207 A1 9/2003 Beigel
2003/0189824 A1 10/2003 Meeder
2003/0231489 A1 12/2003 Hsiao
2004/0001150 A1 1/2004 Schindler
2004/0008157 A1 1/2004 Brubaker
2004/0085745 A1 5/2004 Yoshihara
2004/0128737 A1* 7/2004 Gesten ..... A42B 1/245 2/171
2004/0141312 A1 7/2004 Henning
2004/0141316 A1 7/2004 Twardawski
2004/0165109 A1 8/2004 Lee
2004/0222638 A1 11/2004 Bednyak
2004/0240067 A1 12/2004 Marusi
2004/0240204 A1 12/2004 Russ
2005/0001433 A1 1/2005 Seelin
2005/0035925 A1 2/2005 Ostromek
2005/0047116 A1 3/2005 Gagne
2005/0072458 A1 4/2005 Goldstein
2005/0083676 A1 4/2005 VanderSchuit
2005/0099799 A1 5/2005 Cugini
2005/0105285 A1 5/2005 Maden
2005/0174753 A1 8/2005 Cao
2005/0204490 A1 9/2005 Kemp
2005/0211187 A1 9/2005 Harman
2005/0211574 A1 9/2005 Reeve
2005/0213340 A1 9/2005 Suzuki
2005/0237479 A1 10/2005 Rose
2005/0248932 A1 11/2005 Waters
2005/0254238 A1 11/2005 Parker
2005/0265015 A1 12/2005 Salazar
2006/0012974 A1 1/2006 Su
2006/0012975 A1 1/2006 Huttner
2006/0037125 A1 2/2006 McDowell
2006/0091784 A1 5/2006 Conner
2006/0092621 A1 5/2006 Lai
2006/0093264 A1 5/2006 Tabuchi
2006/0107952 A1 5/2006 Schlosser
2006/0125624 A1 6/2006 Ostrovsky
2006/0126323 A1 6/2006 Pomes
2006/0138440 A1 6/2006 Jyo
2006/0141828 A1 6/2006 Dean
2006/0158895 A1 7/2006 Brands
2006/0165160 A1 7/2006 Winningstad
2006/0198122 A1 9/2006 Senter
2006/0212994 A1 9/2006 Proctor
2006/0215393 A1 9/2006 VanderSchuit
2006/0232955 A1 10/2006 Labine
2006/0238995 A1 10/2006 Wang
2006/0239018 A1 10/2006 Jardin
2006/0263677 A1 11/2006 Tsai
2006/0285315 A1 12/2006 Tufenkjian
2006/0286443 A1 12/2006 Huang
2006/0291193 A1 12/2006 Hill
2007/0003826 A1 1/2007 Hsu
2007/0030442 A1 2/2007 Howell
2007/0048598 A1 3/2007 Huang
2007/0053179 A1 3/2007 Pang
2007/0058361 A1 3/2007 Sevilla
2007/0064413 A1 3/2007 Slater
2007/0072655 A1 3/2007 Cascone
2007/0074752 A1 4/2007 Shau
2007/0086182 A1 4/2007 Kelly
2007/0097668 A1 5/2007 Choi
2007/0140675 A1 6/2007 Yanagi
2007/0145746 A1 6/2007 Biamonte
2007/0153537 A1 7/2007 Scott
2007/0159810 A1 7/2007 Kim
2007/0159823 A1 7/2007 Ho
2007/0171628 A1 7/2007 Seade
2007/0189003 A1 8/2007 Daley
2007/0206373 A1 9/2007 Whiteside
2007/0236649 A1 10/2007 Lin
2007/0236915 A1 10/2007 Chen
2007/0236916 A1 10/2007 Hsu
2008/0049963 A1 2/2008 Mann
2008/0069391 A1 3/2008 Steyn
2008/0130272 A1* 6/2008 Waters ..... A42B 1/244 362/106
2008/0152482 A1* 6/2008 Patel ..... F04B 17/006 415/121.3
2008/0186705 A1 8/2008 Liu
2008/0263750 A1 10/2008 Chen
2008/0266839 A1 10/2008 Claypool
2009/0010474 A1 1/2009 Ouryouji
2009/0126076 A1* 5/2009 Ochoa ..... A42B 1/244 2/171.3
2009/0147503 A1 6/2009 Bennett
2009/0148149 A1 6/2009 Chishima
2009/0268936 A1 10/2009 Goldberg
2009/0323317 A1 12/2009 Spartano
2010/0024091 A1 2/2010 Mehtab
2010/0095431 A1 4/2010 Liao
2010/0134761 A1 6/2010 Johns
2010/0182563 A1 7/2010 Waters
2010/0214767 A1* 8/2010 Waters ..... A42B 1/244 362/106
2010/0242155 A1 9/2010 Carullo
2010/0313335 A1* 12/2010 Waters ..... A42B 1/244 2/209.13
2011/0013135 A1 1/2011 Waters
2011/0075095 A1 3/2011 Waters
2011/0187989 A1 8/2011 Waters
2011/0210685 A1 9/2011 Liao
2011/0211156 A1 9/2011 Beiner
2011/0228211 A1 9/2011 Waters
2012/0014095 A2 1/2012 Waters
2012/0098465 A1 4/2012 Rothschild
2013/0025612 A1 1/2013 Hunter
2013/0192961 A1 8/2013 Waters
2013/0198935 A1 8/2013 Waters
2014/0049947 A1 2/2014 Lombard
2014/0101827 A1 4/2014 Dennis
2014/0173807 A1 6/2014 Waters
2014/0237706 A1 8/2014 OConner
2014/0268683 A1 9/2014 Waters
2014/0270685 A1 9/2014 Letke
2015/0358515 A1 12/2015 Resnick

FOREIGN PATENT DOCUMENTS

AU 199940150 2/2000
AU 199959545 3/2000
AU 2002100976 6/2003
AU 2003100277 7/2003
AU 2003248016 11/2004
CA 2029772 5/1991
CA 2198625 2/1997
CA 2184336 5/1997
CA 2406450 11/2001
CA 2466175 A1 5/2003
CA 2608746 A1 11/2006
CA 2610073 A1 5/2008
CN 86208973 10/1987
CN 2173427 8/1994
CN 2239167 11/1996
CN 2423761 3/2001
CN 2433836 6/2001
CN 2458892 11/2001
CN 2508592 9/2002
CN 2544551 4/2003
CN 1462597 12/2003
CN 1603677 A 4/2005
CN 101950091 A 1/2011

(56) References Cited

FOREIGN PATENT DOCUMENTS

| | | | |
|---|---|---|---|
| CN | 301445845 | S | 1/2011 |
| DE | 3043007 | | 6/1982 |
| DE | 8230583 | | 9/1983 |
| DE | 9410886 | | 9/1994 |
| DE | 29808222 | | 11/1998 |
| DE | 19837151 | | 4/2000 |
| DE | 20007738 | | 9/2000 |
| DE | 29915607 | | 9/2000 |
| DE | 20017922 | | 2/2001 |
| DE | 20020515 | | 8/2001 |
| DE | 20101380 | | 8/2001 |
| DE | 20106261 | | 9/2001 |
| DE | 20111815 | | 11/2001 |
| DE | 10046295 | | 3/2002 |
| DE | 20117740 | | 4/2002 |
| DE | 20201557 | | 5/2002 |
| DE | 20200058 | | 6/2002 |
| DE | 10103591 | | 8/2002 |
| DE | 20110124 | | 8/2002 |
| DE | 10057388 | | 9/2002 |
| DE | 20209115 | | 10/2002 |
| DE | 20210806 | | 10/2002 |
| DE | 10216152 | | 12/2002 |
| DE | 20209611 | | 1/2003 |
| DE | 20313629 | | 12/2003 |
| DE | 10330589 | | 1/2004 |
| DE | 20319297 | | 2/2004 |
| DE | 20318860 | | 4/2004 |
| DE | 20318949 | | 4/2004 |
| DE | 202004004960 | | 9/2005 |
| DE | 102007006860 | A1 | 8/2007 |
| EP | 1072204 | | 1/2001 |
| EP | 1374707 | | 1/2004 |
| EP | 2290433 | A1 | 3/2011 |
| EP | 2299311 | A1 | 3/2011 |
| FR | 1221782 | | 6/1960 |
| FR | 2798721 | | 3/2001 |
| FR | 2824709 | | 11/2002 |
| FR | 2829365 | | 3/2003 |
| FR | 2833068 | | 6/2003 |
| FR | 2833069 | | 6/2003 |
| GB | 2268043 | | 1/1994 |
| GB | 2272073 | A | 5/1994 |
| GB | 2316293 | | 2/1998 |
| GB | 2358575 | | 8/2001 |
| GB | 2363314 | | 12/2001 |
| GB | 2374401 | | 10/2002 |
| GB | 2378117 | | 2/2003 |
| GB | 2378118 | | 2/2003 |
| GB | 2388298 | | 11/2003 |
| JP | S61006304 | | 1/1986 |
| JP | 4289602 | | 10/1992 |
| JP | H08027610 | A | 1/1996 |
| JP | H08298004 | A | 11/1996 |
| JP | H09209210 | A | 8/1997 |
| JP | H09296319 | A | 11/1997 |
| JP | H10081275 | A | 3/1998 |
| JP | H10331019 | A | 12/1998 |
| JP | 2001131818 | A | 5/2001 |
| JP | 3084061 | | 11/2001 |
| JP | 3090973 | | 10/2002 |
| JP | 2004207580 | | 7/2004 |
| JP | 2004346470 | | 12/2004 |
| JP | 2005216832 | A | 8/2005 |
| JP | 2006097156 | A | 4/2006 |
| JP | 2007119980 | | 5/2007 |
| JP | 2008542558 | | 11/2008 |
| KR | 200164075 | | 2/2000 |
| KR | 200168822 | Y1 | 2/2000 |
| KR | 200168826 | | 2/2000 |
| KR | 200260980 | | 1/2002 |
| KR | 20020065405 | | 8/2002 |
| KR | 200331201 | | 10/2003 |
| TW | 241462 | | 2/1995 |
| TW | 275188 | | 5/1996 |
| TW | 286489 | | 9/1996 |
| TW | 324234 | | 1/1998 |
| TW | 329607 | | 4/1998 |
| TW | 386364 | | 4/2000 |
| WO | 9402043 | | 2/1994 |
| WO | 9704434 | | 2/1997 |
| WO | 01013033 | A1 | 2/2001 |
| WO | 01077575 | A1 | 10/2001 |
| WO | 0244611 | | 6/2002 |
| WO | 02062165 | | 8/2002 |
| WO | 02074398 | | 9/2002 |
| WO | 02077520 | | 10/2002 |
| WO | 2003040808 | A2 | 5/2003 |
| WO | 03047377 | | 6/2003 |
| WO | 03083811 | | 10/2003 |
| WO | 2004000054 | | 12/2003 |
| WO | 2004064555 | | 5/2004 |
| WO | 2004103104 | | 12/2004 |
| WO | 2005002378 | | 1/2005 |
| WO | 2005005882 | | 1/2005 |
| WO | 2005038337 | | 4/2005 |
| WO | 2005096856 | | 10/2005 |
| WO | 2005098314 | | 10/2005 |
| WO | 2006037845 | | 4/2006 |
| WO | 2006124928 | | 11/2006 |
| WO | 2007073047 | | 6/2007 |
| WO | 2007073219 | | 6/2007 |
| WO | 2007089236 | | 8/2007 |
| WO | 2007093348 | | 8/2007 |
| WO | 2007112338 | | 10/2007 |
| WO | 2008011750 | | 1/2008 |
| WO | 2009079656 | A2 | 6/2009 |
| WO | 2010099504 | | 9/2010 |
| WO | 2011041591 | A1 | 4/2011 |
| WO | 2011100471 | A1 | 8/2011 |
| WO | 2011137400 | | 11/2011 |
| WO | 2011137406 | | 11/2011 |
| WO | 2013096895 | | 6/2013 |
| WO | 2013096904 | | 6/2013 |
| ZA | 20043826 | A | 9/2005 |

OTHER PUBLICATIONS

'Panther Vision Power Beanie—Available at Bunnings Warehouse,' screenshot of a video posted to Youtube on Jun. 16, 2014. Retrieved from the Internet on Mar. 9, 2015. URL: https://www.youtube.com/watch?v=ZOWodRoEuvc. (1 page).

'Waters Industries' Answer to Defendant's Amended Counterclaims', *Waters Industries, Inc.* v. *Outdoor Cap Co., Inc.*, United States District Court for the Northern District of Illinois, Case No. 1:13-cv-07191, 12 pages (Document No. 38, Dec. 18, 2013).

"4 LED Lighted Fleece Beanie; POWERCAP," article posted online to WISE-SHOP.ca. Added to the businesses catalog on Nov. 6, 2013. Retrieved from the Internet on Jun. 17, 2014. URL: http://www.wise-shop.ca/product_info.php?products_id=489.

"Answer to Complaint, Counterclaims", filed by Sweet Baby, Inc. dba AJ Morgan, *Waters Industries, Inc.* v. *Sweet Baby, Inc. dba AJ Morgan et al.*, United States District Court for the Northern District of Illinois, Case No. 1:09-cv-07595, 15 pages (Docket No. 27, Feb. 4, 2010).

"Complaint", *Waters Industries, Inc.* v. *Kikkerland Design, Inc.*, United States District Court for the Northern District of Illinois, Case No. 1:10-cv-04076, 21 pages (Docket No. 1, Jun. 30, 2010).

"Complaint", *Waters Industries, Inc.* v. *Mr. Christmas Incorporated, et al.*, United States District Court for the Northern District of Illinois, Case No. 1:09-cv-07577, 38 pages (Docket No. 1, Dec. 7, 2009).

"Complaint", *Waters Industries, Inc.* v. *Sweet Baby, Inc. dba AJ Morgan et al.*, United States District Court for the Northern District of Illinois, Case No. 1:09-cv-07595, 78 pages (Docket No. 1, Dec. 7, 2009).

"Complaint", *Waters Industries, Inc.* v. *The Gerson Company*, United States District Court for the Northern District of Illinois, Case No. 1:10-cv-01865,71 pages (Docket No. 1, Mar. 24, 2010).

(56) References Cited

OTHER PUBLICATIONS

"Complaint" with Exhibit A through D, *Waters Industries, Inc.* v. *JJI International, Inc., et al.*, United States District Court for the Northern District of Illinois, Case No. 1:11-cv-03791, 73 pages (Document No. 1, Jun. 3, 2011).
"Defendants' Answer and Counterclaim" and "Responses to Specific Allegations", *Waters Industries, Inc.* v. *JJI International, Inc. and Stein Mart, Inc.*, United States District Court for the Northern District of Illinois, Case No. 1:11-cv-03791, 16 pages (Document No. 15, Jun. 28, 2011).
"Defendants' Initial Non-Infringement and Invalidity Contentions" with Appendix A though G, *Waters Industries, Inc.* v. *JJI International, Inc. and Stein Mart, Inc.*, United States District Court for the Northern District of Illinois, Case No. 1:11-cv-03791, 78 pages (Aug. 9, 2011).
"Kikkerland Design, Inc.'s Answer to Complaint, Affirmative Defenses and Counterclaim", *Waters Industries, Inc.*v. *Kikkerland Design, Inc.*,United States District Court for the Northern District of Illinois, Case No. 1:10-cv-04076, 12 pages (Docket No. 17, Aug. 6, 2010).
"Panther Vision Powercap LED Lighted Beanie," article posted on-line and available for sale at Dick's Sporting Goods with reviews posted as early as Nov. 14, 2014. Retrieved from the Internet on Mar. 9, 2015. URL: http://www.dickssportinggoods.com/product/index.jsp?productId=52376526. (4 pages).
"Plaintiff's Initial Infringement Contentions Under Local Patent Rule 2.2" with Appendix A through F,*Waters Industries, Inc.* v. *JJI International, Inc. and Stein Mart, Inc.*, United States District Court for the Northern District of Illinois, Case No. 1:11-cv-03791, 44 pages (Jul. 26, 2011).
"Plaintiffs Initial Response to Invalidity Contentions Under Local Patent Rule 2.5" with Appendix A and B, *Waters Industries, Inc.* v. *JJI International, Inc. and Stein Mart, Inc.*, United States District Court for the Northern District of Illinois, Case No. 1:11-cv-03791, 29 pages (Aug. 23, 2011).
"Powercap Beanie," article posted on-line to Panther Vision. Publication date unknown. Retrieved from the Internet on Mar. 9, 2015. URL: http://www.panther-vision-promotional-products.com/Prod-18-1-96-10/powercap-trade-beanie.htm. (2 pages).
Docket report of *Waters Industries, Inc.* v. *Kikkerland Design, Inc.*, United States District Court for the Northern District of Illinois, Case No. 1:10-cv-04076, filed Jun. 30, 2010, 4 pages.
Docket report of *Waters Industries, Inc.* v. *Mr. Christmas Incorporated, et al.*, United States District Court for the Northern District of Illinois, Case No. 1:09-cv-07577, filed Dec. 7, 2009, 5 pages.
Docket report of *Waters Industries, Inc.* v. *Outdoor Cap Co., Inc.*, United States District Court for the Northern District of Oklahoma, Case No. 4:13-cv-00665-CVE-FHM, filed Oct. 8, 2013 (7 pages).
Docket report of *Waters Industries, Inc.* v. *Sweet Baby, Inc. dba AJ Morgan et al.*, United States District Court for the Northern District of Illinois, Case No. 1:09-cv-07595, filed Dec. 7, 2009, 7 pages.
Docket report of *Waters Industries, Inc.* v. *The Gerson Company*, United States District Court for the Northern District of Illinois, Case No. 1:10-cv-01865, filed Mar. 24, 2010, 3 pages.
Docket report of *Waters Industries, Inc.* v. *Totes Isotoner Corporation, et al.*, United States District Court for the Northern District of Illinois, Case No. 1:10-cv-04487 filed Jul. 19, 2010 (4 pages).
Extended European search report issued in the related European Application No. 08 86 2753.4 dated Dec. 7, 2012 (7 pages).
Extended European search report issued in the related European Application No. 10 18 1592.6 dated Jan. 31, 2011 (7 pages).
Extended European search report issued in the related European Application No. 10 18 1593.4 dated Feb. 1, 2011 (8 pages).
International Search Report from the International Bureau of WIPO issued in the related International Application No. PCT/US02/35665, dated Jun. 27, 2003, 1 page.
Notification Concerning Transmittal of International Preliminary Report on Patentability and the Written Opinion of the International Searching Authority from the International Bureau of WIPO for International Application No. PCT/US2013/076689, dated Jul. 2, 2015, 7 pages.
Notification of Transmittal of the International Search Report and the Written Opinion of the International Searching Authority, or the Declaration from the International Bureau of WIPO for International Application No. PCT/US10/50978, dated Dec. 3, 2010, 16 pages.
Notification of Transmittal of the International Search Report and the Written Opinion of the International Searching Authority, or the Declaration from the International Bureau of WIPO for International Application No. PCT/US14/28613, 13 pages.
Notification of Transmittal of the International Search Report and the Written Opinion of the International Searching Authority, or the Declaration from the International Bureau of WIPO for International Application No. PCT/US2008/087542 dated May 4, 2009, 12 pages.
Notification of Transmittal of the International Search Report and the Written Opinion of the International Searching Authority, or the Declaration from the International Bureau of WIPO for International Application No. PCT/US2010/025689 dated May 4, 2010, 14 pages.
Notification of Transmittal of the International Search Report and the Written Opinion of the International Searching Authority, or the Declaration from the International Bureau of WIPO for International Application No. PCT/US2011/024400, dated Apr. 29, 2011, 13 pages.
Notification of Transmittal of the International Search Report and the Written Opinion of the International Searching Authority, or the Declaration from the International Bureau of WIPO for International Application No. PCT/US2011/034686 dated Aug. 1, 2011, 16 pages.
Notification of Transmittal of the International Search Report and the Written Opinion of the International Searching Authority, or the Declaration from the International Bureau of WIPO for International Application No. PCT/US2011/051596, dated Jan. 18, 2012, 9 pages.
Notification of Transmittal of the International Search Report and the Written Opinion of the International Searching Authority, or the Declaration from the International Bureau of WIPO for International Application No. PCT/US2014/028945 dated Jul. 31, 2014, 9 pages.
Notification of Transmittal of the International Search Report and the Written Opinion of the International Searching Authority, or the Declaration from the International Bureau of WIPO for related International Application No. PCT/US2011/034695 dated Oct. 28, 2011, 12 pages.
Office Action issued in related Canadian Application No. 2,466,175 dated Sep. 22, 2010 (3 pages).
Office Action issued in related European Application No. 02 778 755.5 dated Feb. 20, 2007 (7 pages).
Office Action issued in related Japanese Application No. 2010-539834 dated Mar. 19, 2013 and English translation of the same (10 pages).
Patent Examination Report issued in related Australian Application No. 2008338320 dated Nov. 1, 2012 (5 pages).
Supplementary European search report issued in the related European Application No. 02 77 8755 dated Jan. 19, 2005 (2 pages).
Written Opinion of the International Searching Authority and International Search Report from the International Bureau of WIPO for International Application No. PCT/US2006/018968, dated Oct. 16, 2006, 12 pages.
Written Opinion of the International Searching Authority and International Search Report from the International Bureau of WIPO for International Application No. PCT/US2008/087542, dated May 4, 2009, 12 pages.
"Answer and Counterclaim of Defendant Outdoor Cap Co., Inc.," *Waters Industries, Inc.* v. *Outdoor Cap Co., Inc.*, United States District Court for the Northern District of Illinois, Case No. 1:13-cv-07191, 11 pages (Document No. 13, Oct. 30, 2013).
"Complaint" , *Waters Industries, Inc.* v. *Totes Isotoner Corporation, et al.*, United States District Court for the Northern District of Illinois, Case No. 1:10-cv-04487 (Jul. 19, 2010) (26 pages).
"Declaratory Judgment Complaint" with Exhibit A and Exhibit B, *Waters Industries, Inc.* v. *Outdoor Cap Co., Inc.*, United States

(56) References Cited

OTHER PUBLICATIONS

District Court for the Northern District of Illinois, Case No. 4:13-cv-00665-CVE-FHM, 52 pages (Document No. 2, Oct. 8, 2013).
"First Amended Answer and Counterclaim of Defendant Outdoor Cap Co., Inc." with Exhibit A through G, *Waters Industries, Inc.* v. *Outdoor Cap Co., Inc.*, United States District Court for the Northern District of Illinois, Case No. 1:13-cv-07191, 201 pages (Document No. 34, Dec. 11, 2013).
"Plaintiff's Complaint" with Exhibit A, *Waters Industries, Inc.* v. *Outdoor Cap Co., Inc.*, United States District Court for the Northern District of Illinois, Case No. 1:13-cv-07191, 7 pages (Document No. 1, Oct. 8, 2013).
"Plaintiff's First Amended Complaint" with Exhibit A and Exhibit B, *Waters Industries, Inc.* v. *Outdoor Cap Co., Inc.*, United States District Court for the Northern District of Illinois, Case No. 4:13-cv-00665-CVE-FHM, 51 pages (Document No. 11, Oct. 10, 2013).
"Plaintiff's Initial Infringement Contentions Under Local Patent Rule 2.2" with Appendix A, Figures 1-5, and Exhibits 1-3, *Waters Industries, Inc.* v. *Outdoor Cap Co., Inc.*, United States District Court for the Northern District of Illinois, Case No. 1:13-cv-07191, 58 pages (Nov. 27, 2013).
"Waters Industries' Answer to Defendant's Counterclaims," *Waters Industries, Inc.* v. *Outdoor Cap Co., Inc.*, United States District Court for the Northern District of Illinois, Case No. 1:13-cv-07191, 5 pages (Document No. 28, Nov. 20, 2013).

* cited by examiner

LIGHTED SOLAR HAT

CROSS-REFERENCE TO RELATED APPLICATIONS

This application claims the benefit of U.S. 61/739,587, filed Dec. 19, 2012 and U.S. 61/800,156, filed Mar. 15, 2013, both of which are hereby incorporated by reference herein in their entirety.

FIELD OF THE INVENTION

This application pertains to lighted headgear and, more particularly, to lighted headgear having solar charging.

BACKGROUND OF THE INVENTION

Often an individual desires a light focused to illuminate an area while performing a task or a light directed in a general forwardly direction along their line of sight for visibility. Holding a flashlight is an option, but such lighting devices are often cumbersome and may detract from the task being completed because only one hand is available for the task since the other hand is holding the flashlight. As a result, hands-free lighting is desirable so that both hands are available for performing a task in lighted conditions.

Headgear is known that may include light sources attached so as to illuminate an area within the wearer's line of vision. The light source may be an LED mounted to a brim portion of a baseball style hat. Generally, these hats have the LED mounted to direct light forwardly from the brim so that the LED axis is parallel with the fore-and-aft brim axis.

The lighted hat can be displayed on a store shelf in a manner so that a potential purchaser can operate an activation switch to turn on the light source. To this end, the hat may be provided to the store with a power source already included so that the light source can be activated by the consumer. However, because the lighted hat may be shipped in bulk to the store with the power source included, the power source can be unintentionally activated through contact of the activation switch with an adjacent one of the packed hats. In particular, where the activation switch is positioned on the hat brim, the light source can be inadvertently turned on during shipping by the hat brim of one hat engaging or depressing the activation switch of another hat nested therewith. Moreover, a user can leave the light source activated after the user is finished using it. For example, after a user has finished using the lighted hat, the user can leave the hat with the light source still activated. Any of these actions undesirably drains the power source so that a subsequent user might not be able to activate the light source.

To this end, it is beneficial to provide rechargeable batteries and a solar panel to recharge the batteries on a lighted hat. One such lighted hat is described in WO 2007/073219 and commercially available by 2C Light Company Limited. More particularly, the '219 application discloses a lighted hat having a completely integrated solar light brim. The brim is formed by layers of plastic and rubber having electronic components received in therebetween. The top of the brim includes a transparent layer of plastic having a rubber strip extending around the perimeter thereof leaving a central transparent portion that extends across a majority of the brim. The bottom of the brim includes a transparent layer of plastic with a pair of dome-shaped downward projections that form compartments therein and a rubber coating applied over the layer of plastic except for forward lens portions of the dome-shaped downward projections. One of the dome-shaped projections includes a downward facing opening therein that is covered by a flexible membrane. The top and bottom of the brim are sealed or molded together with the electronics received therebetween.

The electronics of the '219 hat include a solar panel aligned with the central translucent portion, a pair of light sources mounted within the compartments of the dome-shaped projections to shine light through the non-rubber coated forward lens portions thereof, rechargeable batteries received in each of the dome-shaped projections, and a pushbutton switch mounted in the one of the dome-shaped projections and aligned with the flexible membrane extending over the downward opening. Wires extend across the brim between the top and bottom portions thereof to connect the various components disposed in the separated dome-shaped projections. As is apparent, the construction of this brim is complicated and costly. Moreover, the electronics are sealed within the brim and are spread out over the width of the brim. While many people might be able to pay for the cost associated with such a construction, a person in poverty without a reliable source of energy may not be able to afford the luxury of the rechargeable light provided by a hat as disclosed in the '219 application.

SUMMARY OF THE INVENTION

In one aspect, lighted headgear is disclosed having a head-fitting portion for fitting on a user's head and a brim portion extending in a forward direction from the head-fitting portion. The brim portion includes upper and lower surfaces. An electronic assembly mounted to the hat includes a light source, rechargeable battery, a solar panel, and a switch device. The headgear includes a compact housing that is configured to receive the electronic assembly therein and to be mounted to the headgear. For example, the housing can have a compact width in the lateral direction across the brim so that it extends for less than the full lateral width of the brim. In one example, the lateral width of the brim portion is approximately two and a half to three times greater or more than the width of the housing. The compact housing couples to the brim portion to provide low cost hands free lighting having a rechargeable power source and solar panel. The compact housing mounts to the brim portion such that the solar panel is mounted adjacent to the upper surface of the brim portion and the light source is mounted to project light away from the brim portion. In this manner, the solar panel is more readily exposed to sunlight for recharging the battery when the headgear is worn outside during daylight hours.

In one form, the housing can include upper and lower portions. The upper portion of the housing can be mounted adjacent to the upper surface of the brim portion and the lower portion of the housing can be mounted adjacent to the lower surface of the brim portion, where adjacent as used herein is meant to include next to or at the respective surface. In one approach, brim-facing interior surfaces of the upper and lower housing portions engage the upper and lower surface of the brim portion respectively. The light sources can be mounted to the lower portion of the housing such that they direct light from below the brim portion forwardly of the brim portion, downwardly from the brim portion, or forwardly and downwardly at an angle to the fore-and-aft axis of the brim portion. The upper and lower portions of the housing can be configured to be coupled together so that the housing extends through the brim portion to extend beyond the brim portion thereabove and therebelow. In an alternative approach, externally-facing outer surfaces of the housing upper and/or lower portions can extend substantially flush with corresponding upper and lower brim portion surfaces when the upper and lower housing portions are mounted to the brim portion.

In another form, the headgear includes an electronic assembly including a light source, a rechargeable battery, a solar panel, and a switch device. The switch device is electrically coupled to the light source and has a base with an actuator extending therefrom for shifting by a user to shift the light source between on and off configurations. An upper housing portion is configured to mount to the brim portion adjacent to the upper surface thereof. The upper housing portion includes a frame that is sized to receive the solar panel therein to mount the solar panel for receiving solar or other light energy. A lower housing portion is configured to mount to the brim portion adjacent to the lower surface thereof. The lower housing portion includes a base having a switch opening therein and a bezel or tubular portion. The bezel has a bore extending therethrough that is sized to receive the light source therein and orient the light source to project light away from the brim portion, such as forwardly, downwardly, or at an angle therebetween. The switch device mounts to the lower housing portion so that the actuator thereof extends through the switch opening for being manipulated by a user. The rechargeable battery is received at least partially between the upper and lower housing portions so that the housing has a compact configuration for mounting to the hat.

In another aspect, the headgear includes a substantially water-proof housing mounted to the brim portion with upper and lower portions. An electronic assembly including a light source, a rechargeable battery, a solar panel, and a switch device is received within the housing. A bezel of the housing lower portion is configured to receive the light source and orient the light source adjacent to the brim portion lower surface for directing light away from the brim portion, such as in a forward direction, a downward direction, or at angles therebetween. A window portion of the housing upper portion is configured to receive and orient the solar panel adjacent to the brim portion upper surface for receiving solar or other light energy to charge the rechargeable battery. The housing lower portion includes a switch opening with a flexible cover sealed thereover. The switch device actuator extends into the flexible cover to be accessible by a user to shift the light source between one and off configurations. The switch device actuator can be configured to slide, such as with a slide switch device, or can be configured to be depressed, such as with a push-button switch device.

DETAILED DESCRIPTION OF THE PREFERRED EMBODIMENTS

Figure 1:
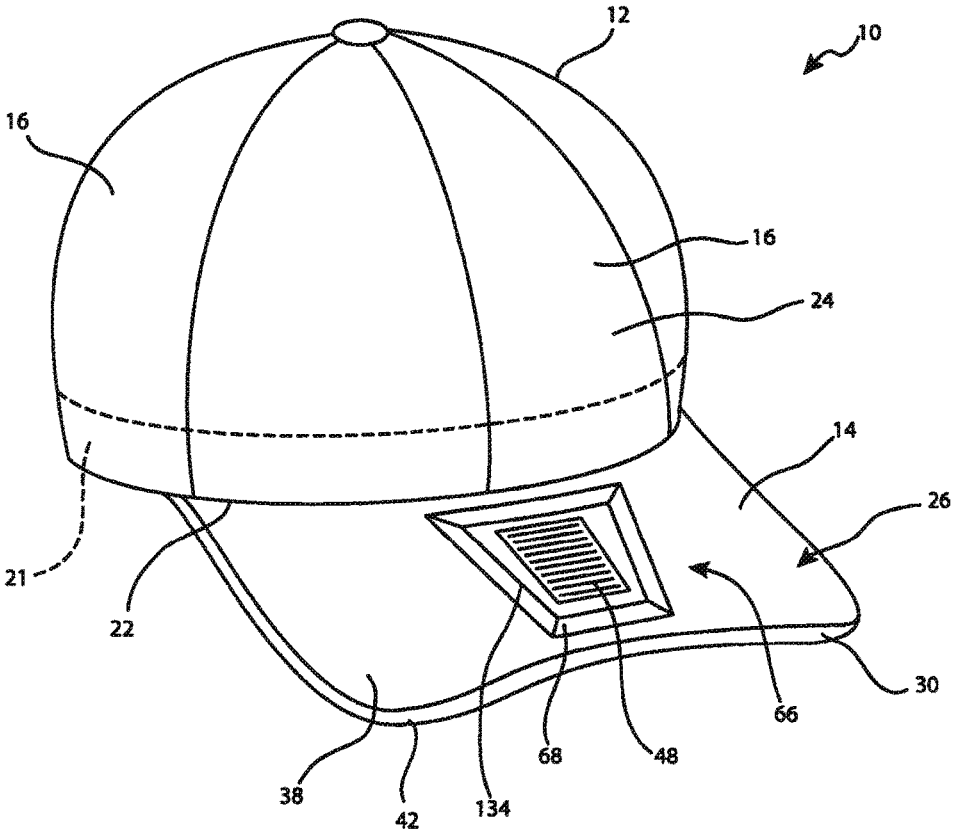
FIG. 1 is a perspective view of a lighted hat having a brim portion and an electronic assembly showing an upper housing portion mounted to a top surface of the brim portion and a solar panel of the electronic assembly received within the upper housing portion.

Headgear is provided herein that includes at least one light source for providing light away therefrom, at least one rechargeable battery for providing power to the light source, and at least one solar panel for recharging the rechargeable battery mounted thereto. As such, the headgear includes a housing configured to at least partially receive the light source, the solar panel, and the rechargeable battery therein. The housing is configured to mount to the hat and advantageously orient the electronic components in desired configurations. For example, the housing mounts the solar panel to the hat so that it can easily receive energy for recharging the rechargeable batteries, and mounts the light sources for directing light away from the hat.

The headgear can be a baseball style hat with a crown portion and a brim portion extending forwardly from the crown portion. In this form, the hat can advantageously have the light sources mounted to a bottom surface of the brim portion and the solar panel mounted to an upper surface of the brim portion. As such, upper and lower housing portions can couple to one another through the brim portion or couple to the brim portion to protect and house the light sources, solar panel, and rechargeable batteries therebetween or therein.

Headgear 10 is shown in FIGS. 1-10 as a standard baseball style hat that includes a head-fitting portion 12 and a brim portion 14. As shown, the head-fitting portion 12 can be constructed from one or more panels 16 of a flexible material or fabric, and, if desired, can include one or more rigid members therebetween to provide structure to the crown 12. The head-fitting portion 12 could alternatively have an annular configuration, such as with visors or the like. The crown 12 can be fitted to a specific size or can have an adjustable strap 18 at a rear portion 20 thereof. Moreover, the crown 12 can include a hat band 21 attached thereto at a lower edge portion 22 thereof. If desired, the hat band 21 can have elastic and/or wicking properties for added comfort. The brim 14 extends forwardly from the lower edge portion 22 of the crown 12 at a forward portion 24 thereof.

The brim 14 has an upper major surface 26, a lower major surface 28, and an outboard edge 30 extending therebetween. In the illustrated form, the brim 14 includes a generally rigid brim insert 32 having upper and lower surfaces 34, 36. The brim 14 further includes upper and lower fabric coverings 38, 40 extending over and covering the corresponding upper and lower surfaces 34, 36 of the brim insert 32. If desired, plastic materials, or combinations of plastic and fabric can be used. The brim 14 of this form further includes a fabric piping 42 extending over the outboard edge 30 and connecting the upper and lower fabric portions 38, 40. As such, the top or upwardly facing surface of the upper fabric covering 38 and the bottom or downwardly facing surface of the lower fabric covering 40 correspond to the upper and lower major surfaces 26, 28 of the brim 14. Alternatively, if the brim 14 does not include the upper and lower fabric coverings 38, 40, the brim insert upper and lower surfaces 34, 36 can correspond to the upper and lower major surfaces 26, 28 of the brim insert 32.

Figure 6:
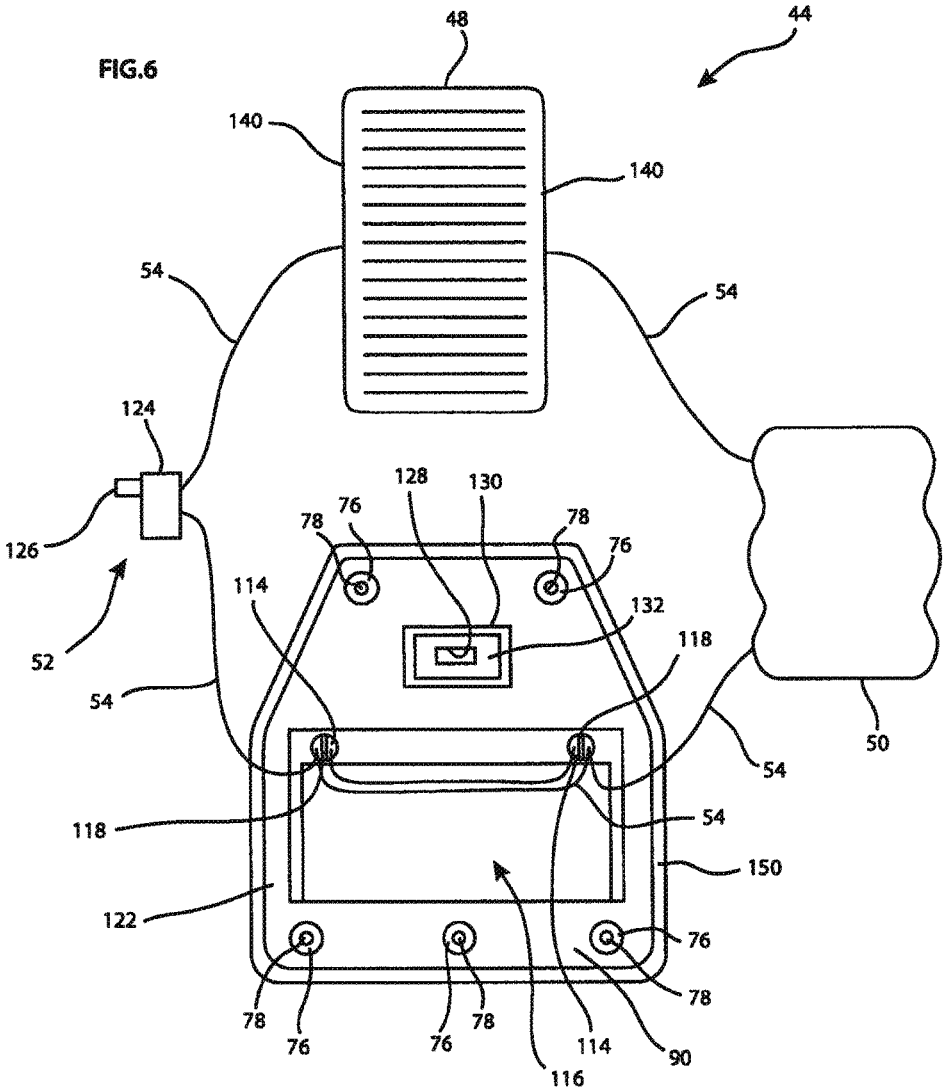
FIG. 6 is a top plan view of the electronic assembly showing the lower housing portion and the switch device, solar panel, and rechargeable battery removed from their mounting locations in the lower housing portion.

The hat 10 includes an electronic assembly 44 mounted thereto, as shown in FIG. 6. The electronic assembly 44 includes one or more light sources 46, one or more solar panels 48, one or more rechargeable batteries 50, a switch device 52, and electrical connections 54, such as circuit boards, wires, solder, traces, or the like, therebetween. The switch device 52 is configured to shift the light sources 46 between on and off states and the solar panel 48 is configured to convert solar or light energy to recharging energy for the rechargeable battery 50. Preferably, the light sources 46 are light emitting diodes (LEDs) having an illumination chip 56, a lens 58 enclosing the illumination chip 56, and a pair of leads 60 projecting rearwardly away from the illumination chip 56 to an exterior rearward position. In addition or instead of the light sources 46, the hat 10 can have other electronic devices mounted thereto and operated by the electronic assembly 44, such as a camera device.

As illustrated, the electronic assembly 44 can be mounted to the brim 14 so that the light sources 46 are adjacent to the lower major surface 28 thereof and the solar panel 48 is adjacent to the upper major surface 26 of the brim 14. In other forms, the light sources 46 can be mounted at the outboard edge 30 of the brim 14, adjacent to the upper major surface 26 of the brim 14 or at least partially between the upper and lower major surfaces 26, 28 of the brim 14. In these various forms, the light sources 46 are mounted to the brim 14 to project light away therefrom, such as forward, downward, upward, sideways, or combinations thereof at angles therebetween. Additionally, the solar panel 48 can also be disposed at least partially between the upper and lower major surfaces 26, 28 of the brim 14.

Figure 8:
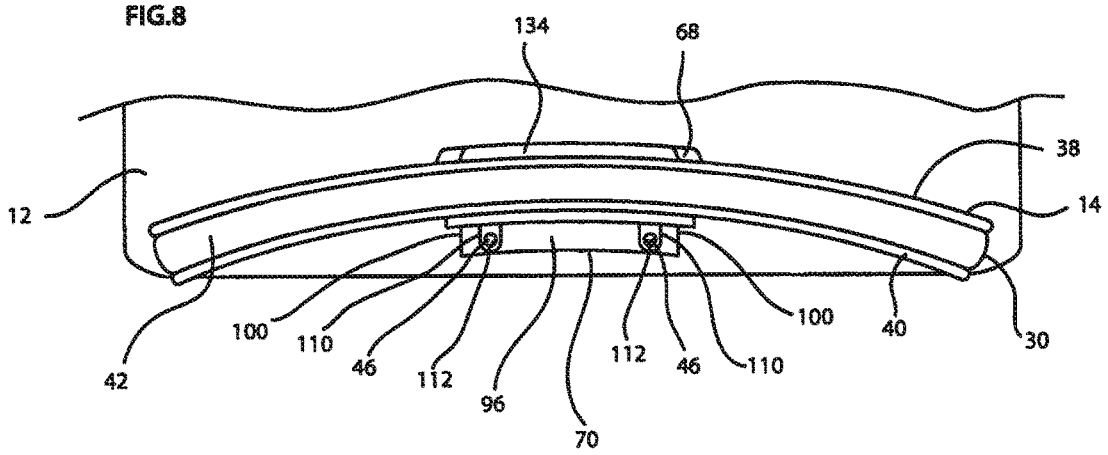
FIG. 8 is a front elevation view of the hat of FIG. 1 showing the upper and lower housing portions mounted to the brim portion and light sources oriented for projecting light forwardly of the hat.

To mount the electronic assembly 44 to the hat 10, the hat 10 further includes a compact electronic assembly housing 66 configured to at least partially receive the electronic assembly 44 therein. In one form, the housing 66 can include upper and lower housing portions or members 68, 70 configured to connect together to sandwich and clamp portions of the brim 14 therebetween. Specifically, the upper housing member 68 can be mounted to the brim upper major surface 26 so as to have at least a portion thereof adjacent to the brim upper surface 26 and the lower member 70 can be mounted to the brim lower major surface 28 so as to have at least a portion thereof adjacent to the brim lower surface 28. As shown in FIG. 8, the upper and lower housing portions 68, 70 can have a curvature generally complementary to the curvature of the brim 14.

In one form, the upper and lower housing members 68, 70 connect to one another through the brim 14 utilizing fasteners 72, such as screws or the like, or snap-fit structure. In order to preserve the aesthetics of the hat 10, the housing 66 is preferably configured so that the screws 72 are inserted from below the brim 14 through openings 73 in the lower housing member 70, so that the screws 72 are only visible underneath the brim 14. In another form, the housing 66 can have a single piece construction that is configured to snap fit or otherwise secure within an opening in the brim 14 so that the upper and lower housing portions 68, 70 are positioned adjacent to the upper and lower brim surfaces 26, 28. In either case, the housing 66 can be removable from the brim 14. As such, if desired, a user could utilize the housing 66 as a standalone rechargeable flashlight when separated from the hat 10 since the housing members 68, 70 can be connected together without the brim portion therebetween.

In one example, the brim 14 can have a lateral width of about 7 inches, a length along the fore-and-aft axis of about 3 inches, and a depth of about 0.25 inches. In addition, the housing 66 can have a lateral width of about 2.5 inches, a length along the fore-and-aft axis of about 2.5 inches, and a depth of about 0.45 inches. In another example, the upper and lower housing portions 68, 70 are separated by about 0.15 inches, such that the housing portions 68, 70 clamp and compress the brim 14 therebetween to deform the brim 14 by about 0.1 inches.

In the form using a multi-piece housing 66, the brim 14 can include openings 74 therethrough to easily allow connecting structure of the upper and lower housing portions 68, 70 to extend therethrough. The openings 74 can extend through the brim insert 32 and, if desired or applicable, the upper and lower fabric portions 38, 40. For secure connection, the upper and/or lower housing members 68, 70 can further include projections or bosses 76 that are configured to extend at least partially into the brim insert 32. In the form utilizing screw fasteners 72, the projections 76 include bores 78 therethrough to receive the screw fasteners 72. The bores of the projections 76 of the upper housing member 68 are threaded so that the screw fasteners 72 engage can the threads and tightly secure the upper and lower housing members 68 70 together capturing the brim 14 therebetween. If desired, the lower housing member 68 can include indentations 80 around the openings 73 in a downwardly facing surface 82 thereof, so that the screw fasteners 72 don't project past the surface 82 after the housing has been assembled.

In the illustrated form, the housing portions 68, 70 include five projections 76 and the brim 14 includes five corresponding openings 74; however, other configurations can also be utilized. As shown, the housing portions 68, 70 include three projections 76 along the sides thereof closest to the crown 12 and two projections 76 on sides thereof closet to the brim front edge.

Instead of coupling together through the brim 14, the upper and lower housing members 68, 70 can couple to the brim 14. For example, the brim openings 74 can have threads therein or nuts or the like can be mounted within the openings 74. So configured, the screw fasteners 72 can be utilized to individually connect the upper and lower housing members 68, 70 to the brim by securing to threads within the openings 74.

The lower housing member 70, details of which are illustrated in FIGS. 2-4, 6, and 10, includes a generally planar base portion 84 and an offset or enlarged portion 86 that is offset with respect to adjacent portions of the base 84. As shown, the offset portion 86 is spaced from outer edges 88 of the lower housing portion 70 by perimeter portions 90 of the base 84. The perimeter portions 90 provide ideal placement for the openings 73, the indentations 80, and the projections 76 aligned therewith for the screw fasteners 72 so that the projections 76 or other connecting structure does not interfere with positioning of the electronic assembly 44 within the interior of the housing 66. In the illustrated form, the housing lower member 70 has a footprint with a rectangular rear portion 92 and a trapezoidal forward portion 94 with the offset portion 86 positioned generally within the rectangular rear portion 92.

As shown, the offset portion 86 is generally boxed shaped, having a front wall 96, a rear wall 98, side walls 100, and a bottom wall 102. The bottom wall 102 is described as such due to the orientation of the housing lower member 70 when mounted to the lower surface 28 of the brim 14. The offset portion 86 preferably has an open top 104 so that when the lower housing member 70 is mounted to the hat brim 14, the offset portion 86 provides a recessed well or compartment 116 for the larger components of the electronic assembly 44, such as the rechargeable battery 50.

The rechargeable batteries 50 are preferably mounted adjacent to the lower major surface 28 of the brim 14 and/or at least partially between the upper and lower brim major surfaces 26, 28, so that the housing 66 depth is minimized and the brim 14 maintains a streamlined appearance. Additionally, with the solar panel 48 mounted adjacent to the brim upper surface 26, the width of the housing 66 can have a more compact configuration with the rechargeable batteries 50 positioned underneath the solar panel. If desired, however, the rechargeable batteries 50 can also be mounted adjacent to the upper major surface 26 of the brim 14 or mounted to the crown 12 of the hat 10. Moreover, the solar panel 48 can be mounted at least partially between the upper and lower major surfaces 26, 28 of the brim 14 or to the crown portion 12.

As discussed above, the compartment 116 of the offset portion 86 provides additional space for the electronic assembly 44. Specifically, as the rechargeable batteries 50 are potentially the largest component of the electrical assembly 44, the compartment 116 of the offset portion 86 provides an ideal storage location therefor. Moreover, the offset portion 86 can have a different configuration than generally rectangular. For example, the offset portion 86 can conform to a footprint and/or depth of the rechargeable batteries 50.

Figure 5:
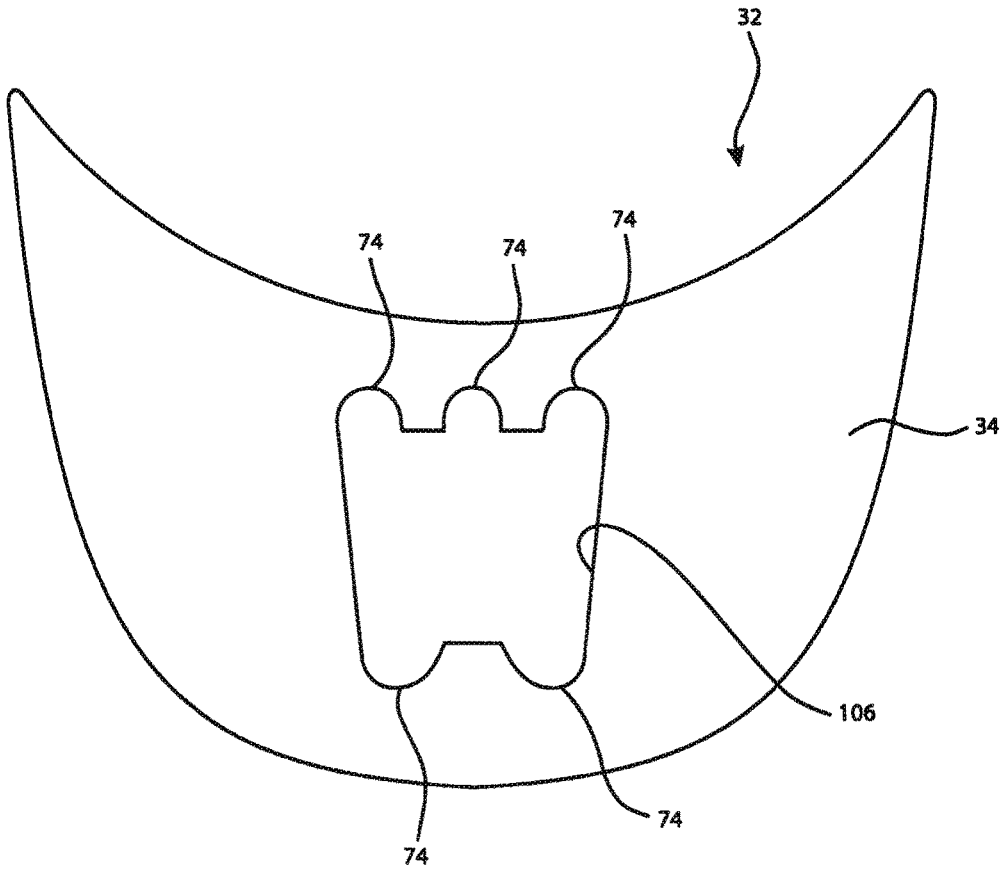
FIG. 5 is a top plan view of a brim insert of the brim portion showing a through opening including outer extensions for the fasteners connecting the housing portions.

As shown in FIG. 5, in order to provide additional room to carry the electronic assembly 44, the brim insert 32 can include a cut-out 106 therein located generally inbetween or connected to the hardware openings 74. By removing a portion of the brim insert 32, the rechargeable batteries 50 can be positioned at least partially between the upper and lower surfaces 34, 36 thereof, which advantageously allows the depth of the offset portion 86 to be minimized and, therefore, the hat 10 is able to maintain a generally traditional appearance.

Moreover, the upper and lower brim coverings 38, 40 can include a cut-out or opening 108 corresponding to the cut-out 106 in the brim insert 32. In the form illustrated in FIG. 4, the covering cut-out 108 is a pair of overlapping cuts in an X-shaped pattern. This configuration allows for fast assembly of the hat 10; i.e., quick preparation of the cut-out 108 during brim assembly. The cut-out 108 can be advantageously sized so that the solar panel 48 can be inserted through the brim 14 to be mounted adjacent to the upper surface 26 thereof. This configuration allows the electronic assembly 44 to be pre-assembled and wired, which saves time during assembly of the hat 10. Once mounted, the wires 54 can easily pass through the opening 108 connecting the solar panel 48 with other components of the electronic assembly 44. Alternatively, the covering cut-out 108 can be a removed portion of the covering material that generally corresponds to the shape of the brim insert cut-out 106.

The housing lower member 70 further includes a pair of bezels or tubular portions 110 that project away from the front wall 96 of the offset portion 86. The bezels 110 are shown connected with the base portion 84 of the lower housing member 70, but can be separated therefrom if desired. Moreover, the bezels 110 can be integral with the lower housing portion 70 as shown, or can be attached thereto.

Figure 10:
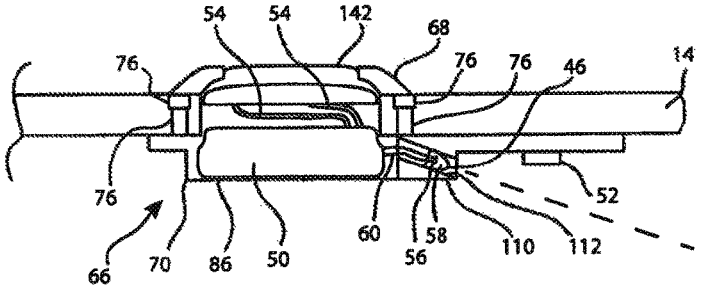
FIG. 10 is a cross-section view of the brim portion of the hat of FIG. 1 showing the upper and lower housing portions mounted thereto and having the electronic assembly received therein with the light sources directing light at a forward and downward cant angle with respect to the fore-and-aft axis of the brim portion

The bezels 110 have a cylindrical bore 112 therethrough within an opening 114 into the interior 116 of the offset portion 86 and, therefore, in the interior of the housing 66 when the upper and lower housing members 68, 70 are coupled together. As such, the light sources 46 can be received within the bezels 110 and the bezels 110 are configured to orient the light sources 46 to provide light forwardly of the hat 10. If desired, the bores 112 of the bezels 110 can be angled downwardly with respect to the plane of the hat brim 14, as shown in FIG. 10, so as to provide light forwardly and downwardly of the hat 10, such as to a reading or working area of a wearer of the hat 10. In other forms, the bezels 110 and bores 112 can extend generally parallel to the plane of the hat brim 14 to project light forwardly of the hat 10, perpendicular to the plane of the hat brim 14 to project light downwardly, or be oriented outward to project light sideways of the hat 10, such as for safety lighting. Alternatively, the light sources can be mounted to the housing 66 to project light in other directions, such as sideways, to act as a safety mechanism. In the illustrated form, the bezels 110 are sized for the LEDs 46 to be mounted therein, so that the bezels 110 extend beyond the illumination chips 56 of the LEDs 46 to block stray light from shining into the eyes of a wearer of the hat 10. The bezels 108 can alternatively project from a forward facing surface of any other shaped offset or directly from the base 84.

The offset portion 86 can alternatively simply have the openings 114 in the front wall 96 thereof and the LEDs 46 can be positioned at least partially inside the offset portion 86 to project light forwardly through the openings 114. Moreover, it will be understood that the bezels 110 and other light directing structure described herein can also be provided on the upper housing member 68.

In one form, the bezels 108 can each have a socket at the opening 114 to the interior 116 of the housing 66 to separate the leads 60 of the light sources 46. Specifically, the opening 114 can have a span 118 thereacross to generally divide the opening 114 into two halves. As such, the span 118 can separate the leads 60 of the lights sources 46 for easier electrical connection to the other components of the electronic assembly 44.

Additionally, if more space for the bezel 110 and bore 112 therethrough is needed, the lower housing member 70 can include extensions 120 that project from an inner surface thereof 122 to be offset therefrom and aligned with in the bezels 110 on the outer surface 82. The extensions 120 provide additional thickness to the bezels 110 and, therefore, allow for a greater downward angle for the bore 112. As such, the hat 10 can be configured to provide a user with light in a more downwardly direction without increasing the thickness of the entire lower housing member 70, saving production costs.

The switch device 52 includes a base 124 and an actuator 126 extending away from the base 124 for shifting by a user. In the illustrated form, the switch device 52 is a slide switch, so the actuator 126 is configured to shift laterally with respect to the base 124 to cycle the light sources 46 between on and off configurations. It will be understood, however, that the switch device 52 can take any suitable form, including a push button switch, a rotary switch, or the like.

The switch device 52 is mounted to the lower housing member 70 to be accessible to a wearer of the hat 10 while the hat 10 is on the wearer's head. In one form, the switch device 52 is mounted to the inner surface 122 of the lower housing member 70 and the lower housing member 70 includes a switch opening 128 through which the switch actuator 126 extends. In the form utilizing a slide switch, the switch opening 128 can be an elongate opening to allow for lateral shifting of the actuator 126.

As discussed, the switch base 124 is mounted to the inner surface 122 of the lower housing member 70. In order to make the mounting process easier and ensure secure mounting of the switch device 52, the lower housing member 70 can further include an upstanding wall 130 on the inner surface 122 thereof that creates a bay or compartment 132 for reception of the switch device 52. The upstanding wall 130 extends around the switch actuator opening 128, so that the switch device 52 can be deposited within the bay 132 with its actuator 126 projecting downwardly through the opening 128. Preferably, the bay 132 is sized to generally match the footprint and depth of the switch base 124. If desired, the bay 132 can be sized so that the switch device 52 is received in a friction fit therein. Alternatively, or in addition thereto, an adhesive or epoxy can be applied over the switch device 52 after it has been mounted within the bay 132 and electrically attached to other components of the electrical assembly 44. The upper housing portion 68 can be also configured to include the bay 132 and switch actuator opening 128, and other features discussed above, so that the switch device 52 can be mounted to the upper housing member 68.

Figure 7:
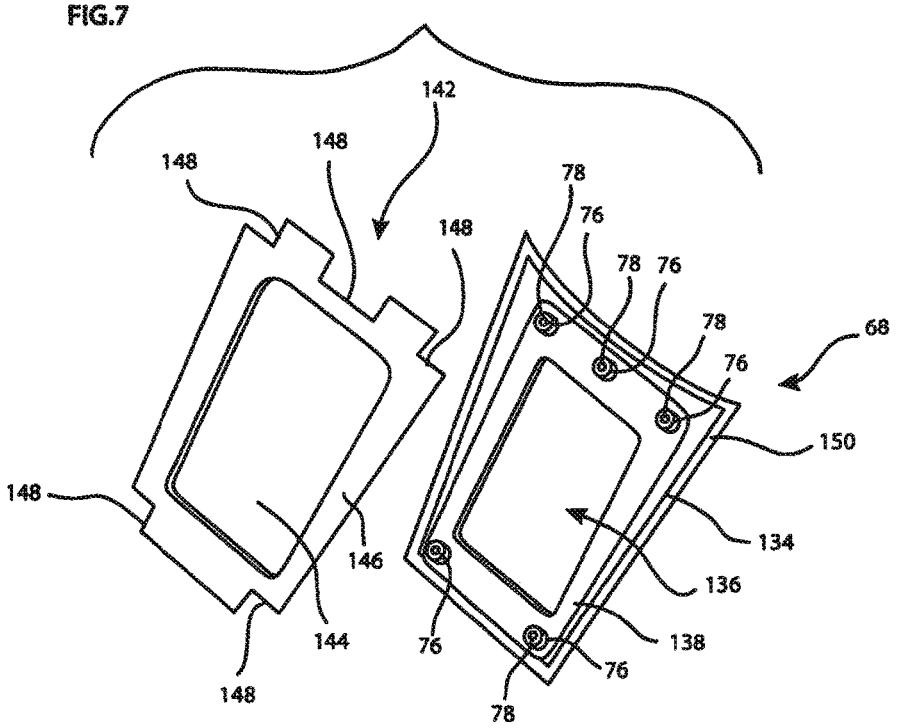
FIG. 7 is an exploded perspective view of the upper housing portion having a frame portion and a cover with a raised central region sized to fit within the frame portion and a flange configured to engage the upper housing portion.

As described above, the upper housing member 68, details of which are shown in FIGS. 1 and 7, is configured to mount to the upper surface 26 of the brim 14. The upper housing member 68 includes a perimeter frame portion 134 defining a central window region 136. The central window region 136 provides an ideal placement for mounting the solar panel 48 to the upper surface 26 of the brim 14. Specifically, the solar panel 48 can be sized to fit within the central window region 136 and engage an inner surface 138 of the upper housing member 68 with edges 140 thereof to prevent the solar panel 48 from dislodging after the upper and lower housing members 68, 70 are secured together or coupled to the brim 14.

In order to protect the solar panel 48 from damage, i.e., from weather, debris, or other physical damage, the housing 66 can further include a cover 142 configured to extend over and cover the central window region 136, and the solar panel 48 mounted therein. The cover 142 includes a raised central region 144 configured to be generally complementary to the shape of the solar panel 48 and sized to fit within the central window region 136 of the upper housing member 68. The cover 142 further includes an outwardly extending flange 146 configured to engage the inner surface 138 of the upper housing member 68 so that the flange 146 is captured between the upper housing member 68 and the brim 14 when the upper and lower housing members 68, 70 are secured together or coupled to the brim 14. As shown, the flange 146 can include cut-outs 148 corresponding to the location of the projections 76 so that the flange 146 can easily nest into placement with the upper housing member 68.

As discussed above, the upper and lower housing members 68, 70 can be secured together with the projections 76 thereof abutting one another. In order to provide a tight grip on the brim 14 of the hat 10, the upper and lower housing members 68, 70 can each further include a rim 150 projecting inwardly toward the brim 14 from their respective inner surfaces that extends around the perimeter edges thereof. The rims 150 are preferably sized, so that when the housing 66 is assembled with the upper and lower housing members 68, 70 attached to one another, the rims 150 compress and slightly deform the brim 14 to ensure a secure mounting of the housing 66.

So configured, the housing 66 is configured to receive the electrical assembly therein and mount to the hat brim 14 to provide hands-free light with a rechargeable energy source.

Figure 2:
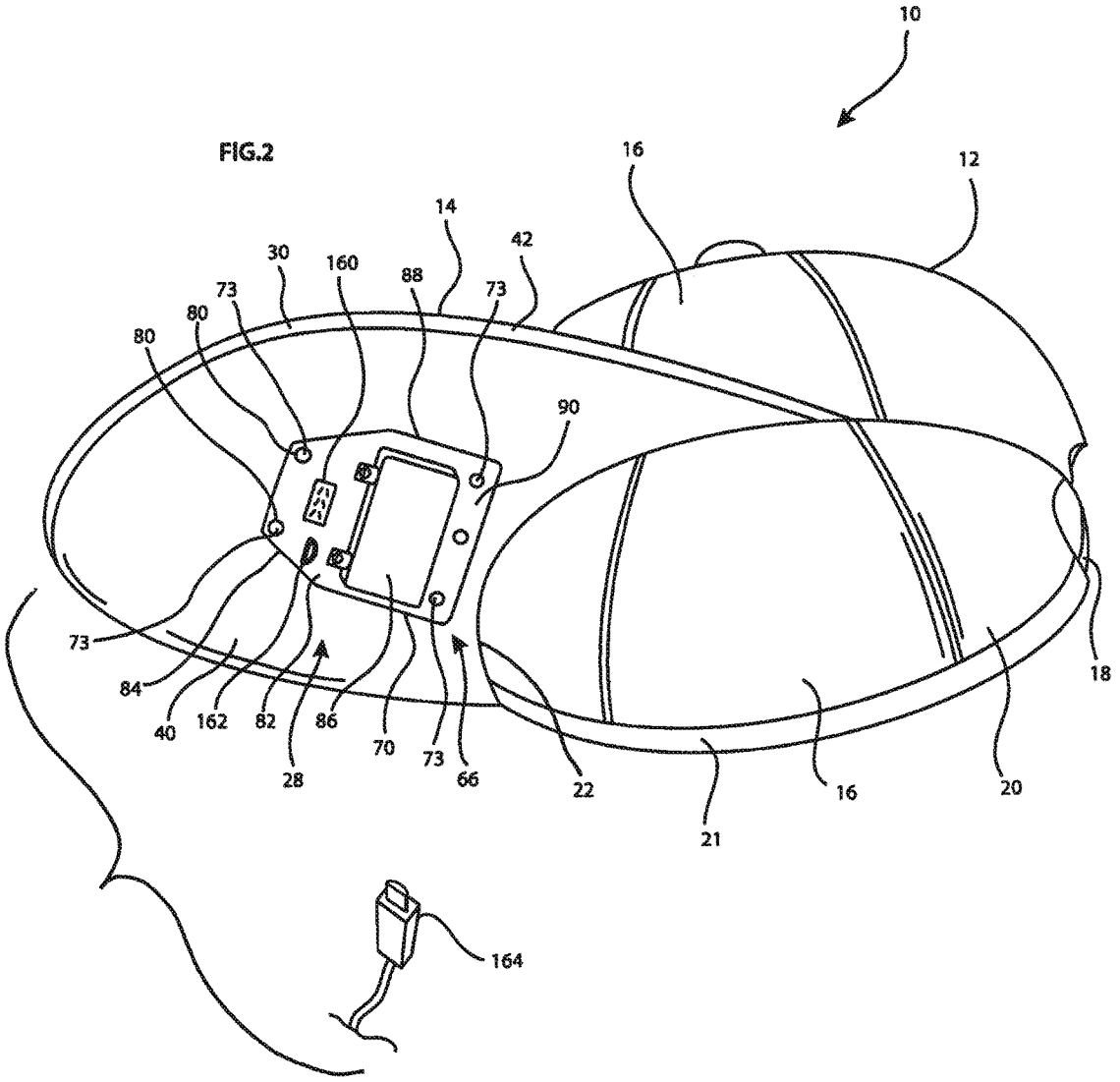
FIG. 2 is a bottom perspective view of the lighted hat of FIG. 1 showing a lower housing portion mounted to a bottom surface of the brim portion with a sealed switch cover mounted thereto and light bezels extending therefrom.
Figure 3:
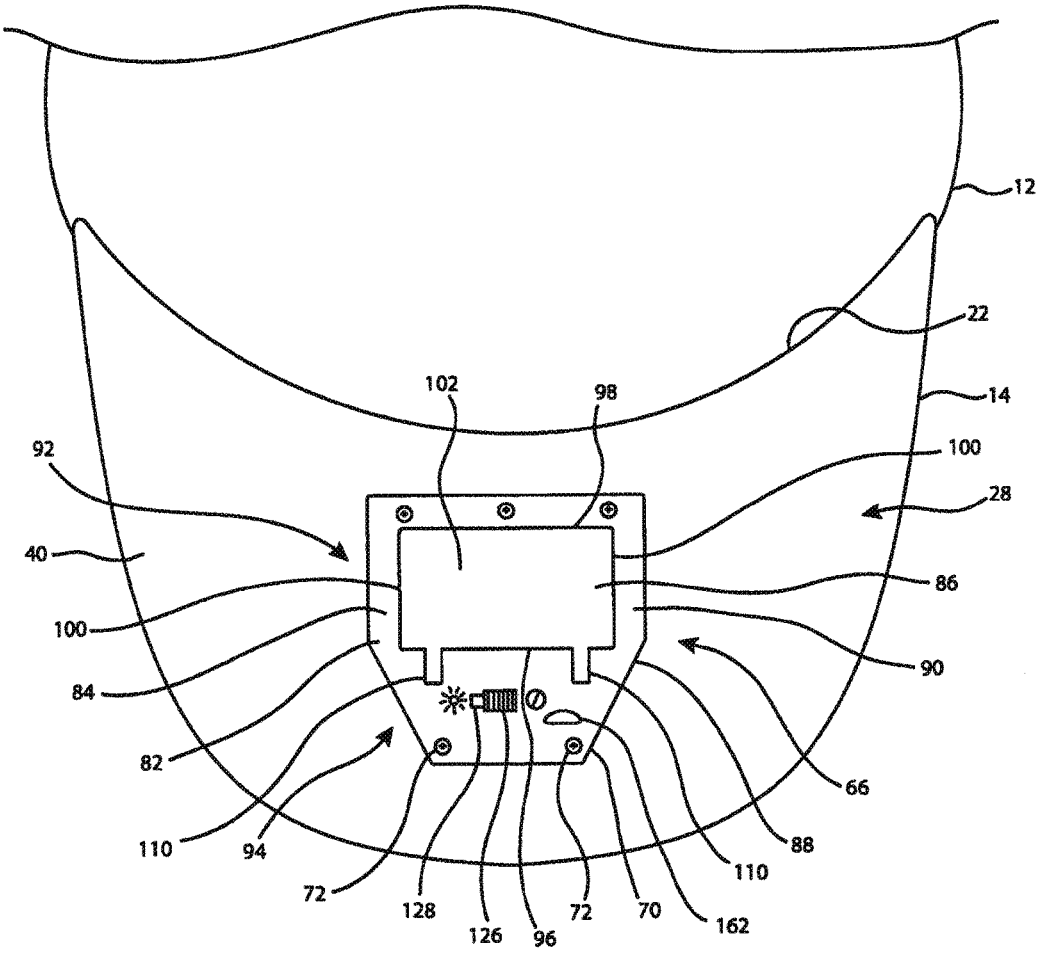
FIG. 3 is a bottom plan view of the lighted hat of FIG. 2 showing the lower housing portion mounted to the bottom surface of the brim portion with a slide switch device of the electronic assembly mounted thereto.
Figure 4:
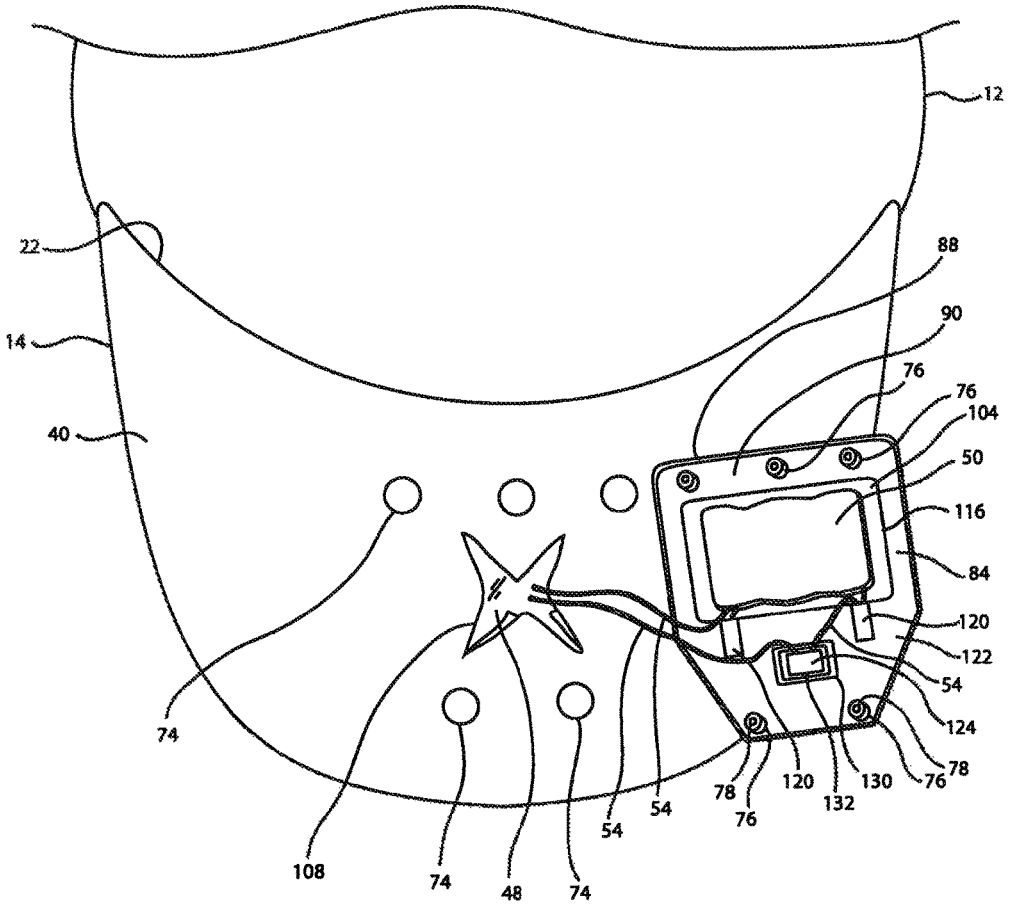
FIG. 4 is a bottom plan view of the hat of FIG. 2 with the lower housing portion removed from the brim portion and pivoted to show the switch device and rechargeable batteries of the electronic assembly electrically coupled together.
Figure 9:
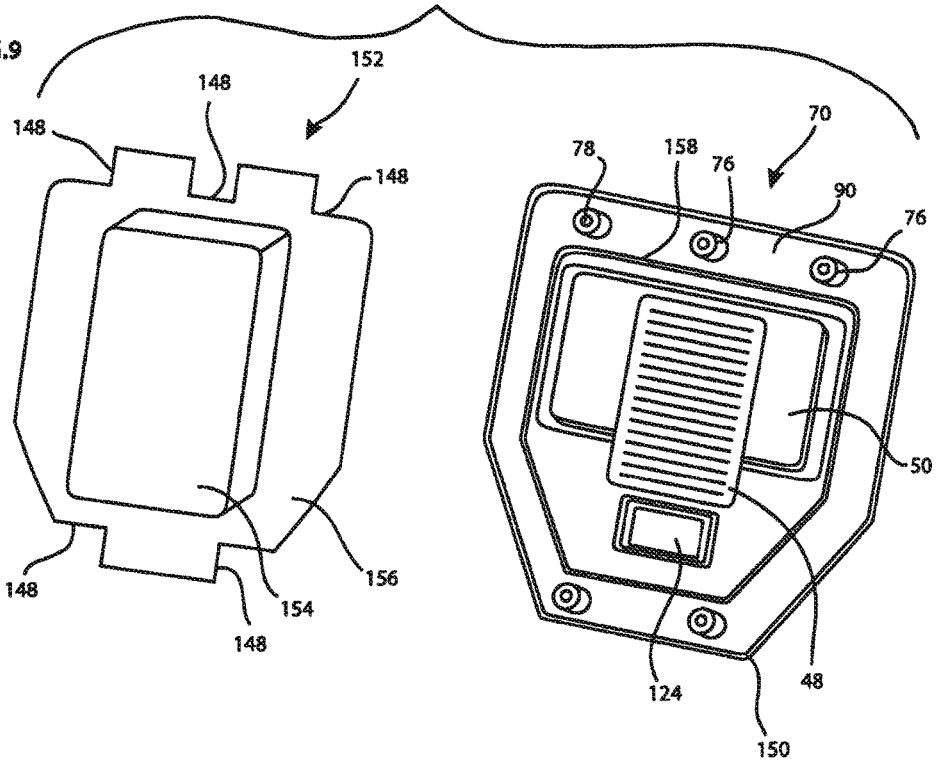
FIG. 9 is a perspective view of components of an alternative housing showing an alternative cover and the alternative lower housing portion having the electronic assembly received thereon with a ridge extending therearound and the alternative cover sized to extend over the solar panel for being engagingly sealed to the ridge.

In another configuration, the housing 66 can substantially prevent the ingress of water therein to minimize water damage to the components of the electronic assembly 44. Various waterproofing features of this second form of the housing 66 are shown in FIGS. 2 and 9. The upper and lower housing members 68, 70 can have substantially similar structures as set forth above, so only the differences will be discussed hereafter.

In this form, the housing 66 includes an enlarged cover 152 with a raised central region 154 that extends over to cover the solar panel 48 and fit within the window region 136 of the upper housing member 68 similar to the above cover 142. Instead of having the flange 146 that is configured to nest between the upper housing member 68 and the brim 14, the enlarged cover 152 includes a flange 156 that is configured to nest between the lower housing member 70 and the brim 14. Specifically, the raised central region 154 has a greater depth than the earlier described cover 142, so that the enlarged cover 152 passes through the openings 106, 108 in the brim insert 32 and the upper and lower coverings 34, 36 thereon. The flange 156 then extends outwardly to abut the perimeter portions 90 of the lower housing member 70. Advantageously, the lower housing member 70 can include a molded ridge 158 extending around the lower housing member 70 in the perimeter portions 90 thereof that aligns with the flange 156 of the enlarged cover 152. Using ultrasonic welding, adhesive, or the like, the enlarged cover 152 can then be sealed to the lower housing member 70 to thereby prevent the ingress of water therebetween.

While the configuration with the enlarged cover 152 substantially protects the electronic assembly 44 from water damage, the bezels 110 and the switch opening 128 can also be configured to prevent water ingress into the housing 66. For the bezels 110, a sealant can be inserted or deposited into the bore 112, which seals the opening 114 into the housing 66 and can protect the leads 60 of the light sources 46.

For the switch opening 128, a flexible rubber or plastic switch cover 160 can be mounted over the switch opening 128 in the lower housing member 70 and sealed or welded thereto. The switch actuator 126 projects through the openings 128 into the flexible cover 160 for being manipulated by a user. As such, the opening 128 is sealed against the ingress of water, but the flexibility of the switch cover 160 allows a user to actuate the switch device 52.

So configured, the electrical assembly 44 can be protected from water damage and a user of the hat 10 can be provided with cost-effective hands-free lighting having a rechargeable light source that can be used in adverse situations and settings. Such a hat 10 is particularly suitable for reliable lighting in areas without consistent electrical supply.

In another form, the electrical assembly 44 can include a port or socket 162 that is electrically connected to the rechargeable batteries 50 and is configured to receive a plug 164 therein for recharging the batteries. The port can be any suitable structure, such as USB, mini-USB, or the like. While the solar panel 48 can provide reliable recharging in many settings, the port 162 can provide a suitable alternative in situations having an electrical supply or can supplement the solar panel 48 when the rechargeable batteries 50 run out of power and a suitable recharging light source is unavailable. Moreover, a rubber cap or cover can be configured to plug the port 162 when it is not being used to protect the port 162 and other components of the electronic assembly 44 from damage, such as by water, debris, or the like.

Moreover, the port 162 can be used to charge or power devices not mounted to the hat 10. For example, a portable electronic device, such as a phone, tablet, or the like, can plug into the port and receive power from the rechargeable batteries 50. This is particularly advantageous in areas without a consistent electrical supply. The independent and rechargeable configuration of the hat 10 can be utilized to power and recharge devices in addition to the light sources 46.

Figure 11:
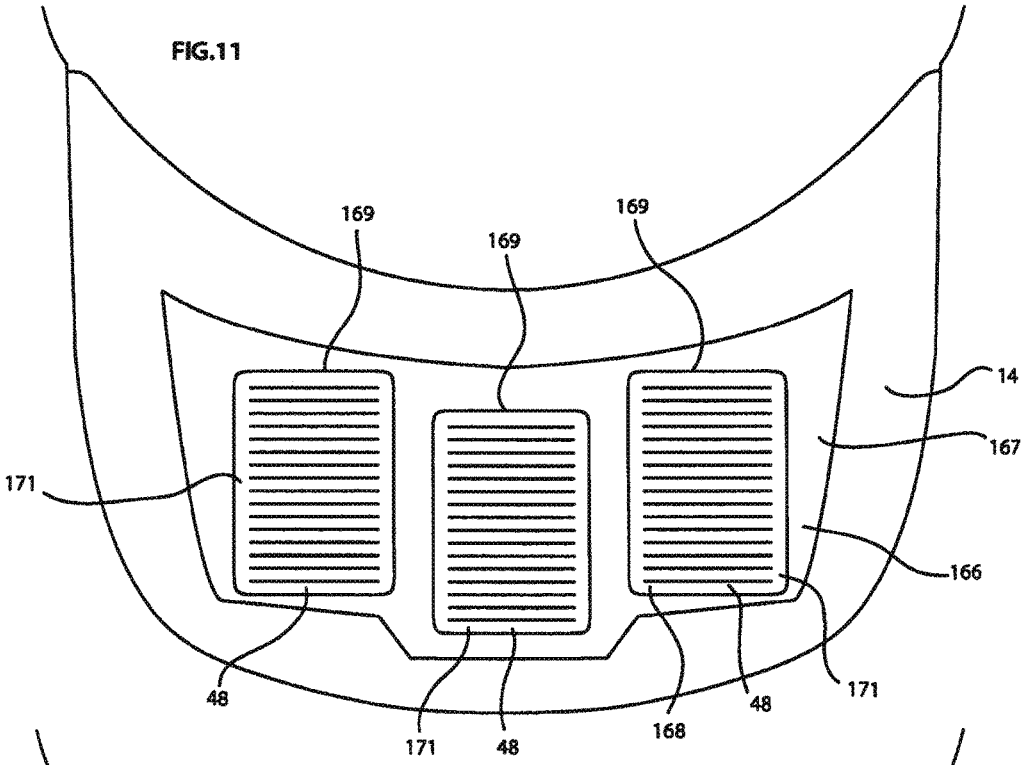
FIG. 11 is a top plan view of a brim portion of a hat showing an alternative configuration for three solar panels to be mounted thereto.
Figure 12:
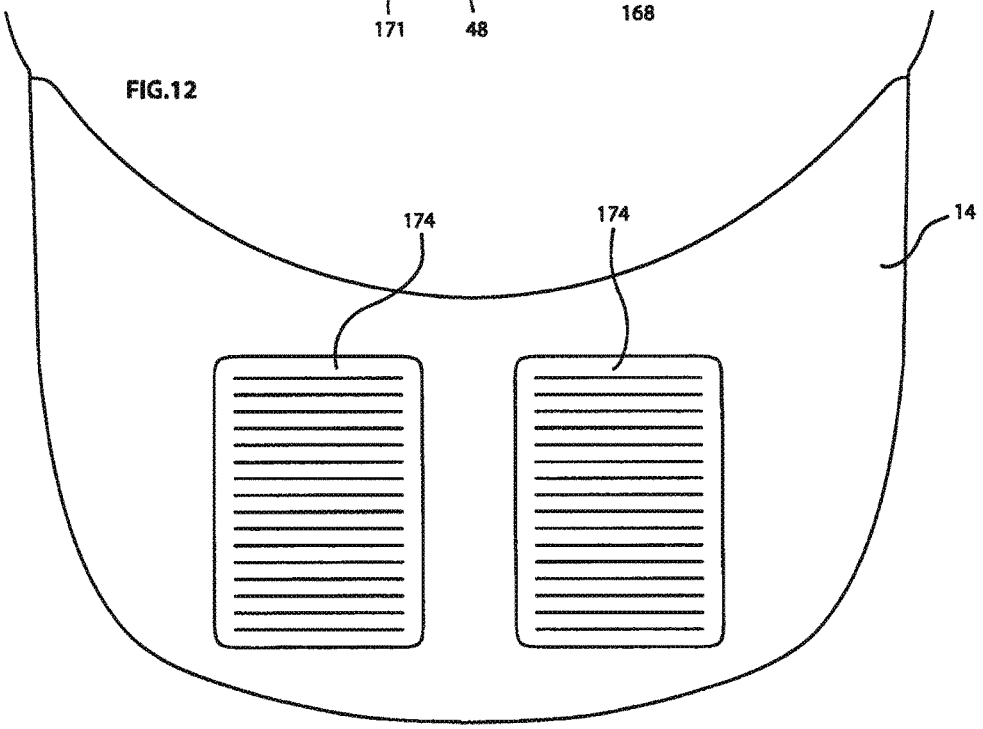
FIG. 12 is a top plan view of a brim portion of a hat showing an alternative configuration having two solar panels mounted thereto.
Figure 13:
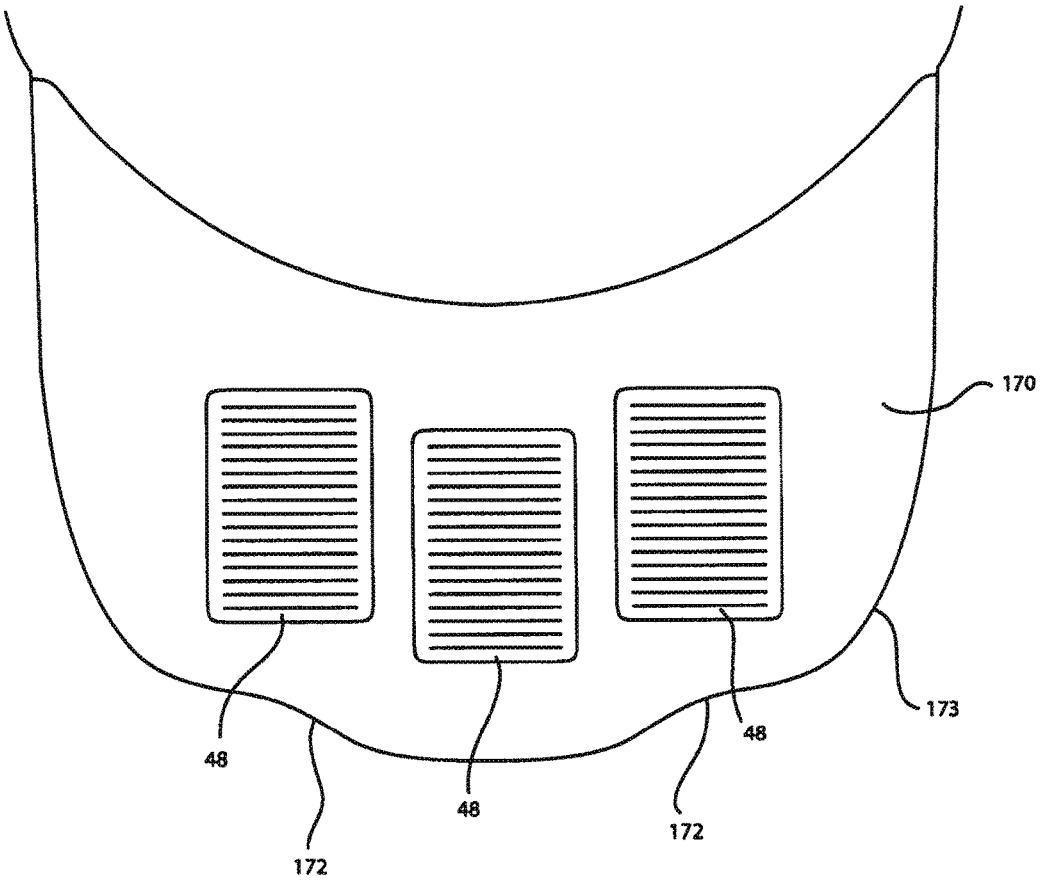
FIG. 13 is a top plan view of a brim portion of a hat showing an alternative configuration having three solar panels mounted thereto and the brim portion having an irregular shape to be generally complementary to the arrangement of the three solar panels.

Alternative brim and solar panel configurations are shown in FIGS. 11-13. As discussed previously, the headgear described herein generates power that is used to charge a rechargeable power source, which can then be used to power electrical devices mounted to the headgear or devices external thereto. In such cases, it can be beneficial to have solar panels covering as much surface area as possible so that the rechargeable power source can be kept in a charged condition. FIGS. 11-13 show alternative brim configurations having more solar panel surface area as compared to the headgear of FIG. 1.

In a first form, shown in FIG. 11, the brim 14 is structured as set forth above except that it includes three solar panels 48 mounted thereto in a staggered arrangement that is generally complementary to the curvature of the brim 14. The solar panels 48 can be electrically coupled to other components as set forth herein without limitation. Further, the brim 14 can have an upper housing portion 166 mounted thereto that is similarly structured to the upper housing portion 68 discussed above, except it is sized to extend around and cover the three solar panels 48. The upper housing portion 166 includes a perimeter frame portion 167 defining three central regions 169 therein where the solar panels 48 are disposed. Specifically, the solar panels 48 are sized to fit within the window regions 169 and engage an underside of the frame portion 167 with edges thereof to prevent the solar panels 48 from dislodging. The upper housing portion 166 can further include a single piece cover or three separate covers 171 that are configured to extend over and cover the solar panels 48 and secure between the housing and the brim with an outwardly extending flange, as described above.

By another approach, as shown in FIG. 13, an irregularly shaped brim 170 can have the three solar panels 48 of FIG. 11 mounted thereto and can further include indents or removed portions 172 forwardly of the side solar panels 48. In this manner, the forward edges # of each of the solar panels 48 are at approximately the same distance from the corresponding forward edge 173 of the brim portion 170. As such, a forward edge 173 of the brim portion 170 is generally complementary to the staggered arrangement of the solar panels 48 to provide a unique product display.

In a second from, shown in FIG. 12, the brim 14 is structured as set forth above except that it includes two relatively larger solar panels 174 compared to those described above. The larger solar panel provides a larger surface area to thereby produce more energy. The larger solar panels 174 provide good surface area coverage, while also reducing the electronic connections, components, and labor necessary for three or more solar panels. With the two solar panels 174 of FIG. 12, a lesser number of solar panels need to be electrically connected and a fewer number of electrical connections need to be mounted to the brim 14. The larger solar panels 174 can utilize protective housings as described herein, either individually or enlarged to cover both panels.

Figure 14:
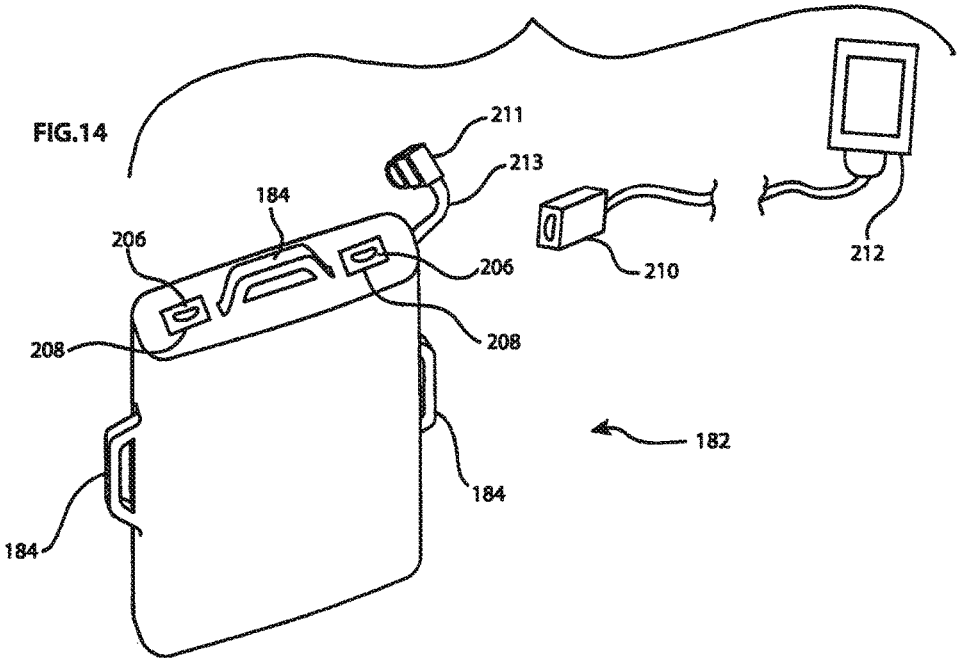
FIG. 14 is a rear perspective view of a battery pack for electronic components showing attachment handles and two ports.
Figure 15:
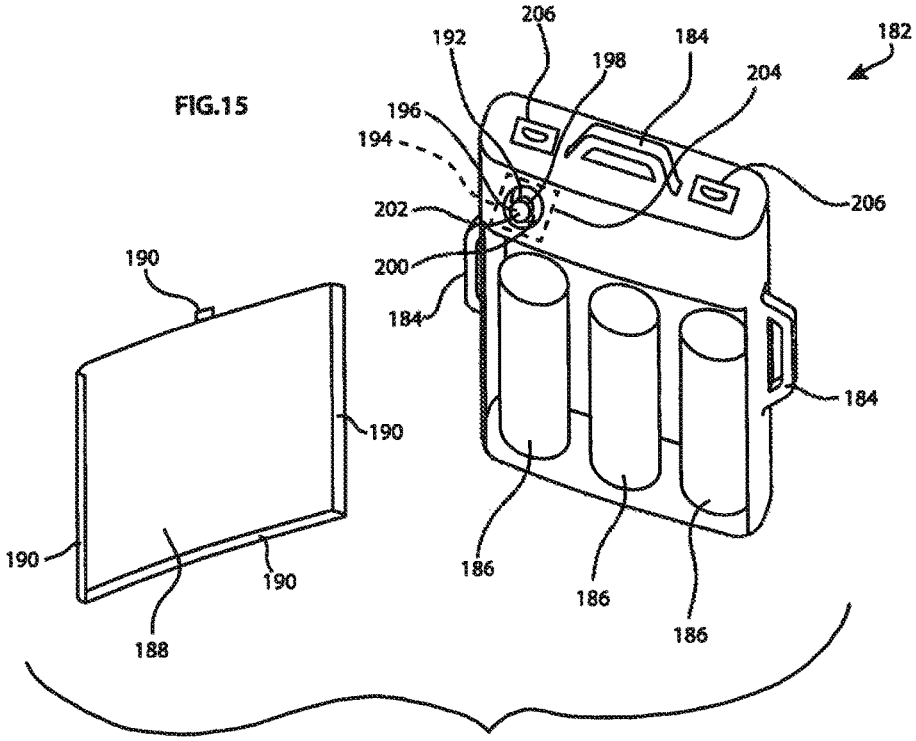
FIG. 15 is a front perspective view of the battery pack of FIG. 14 showing a power source compartment and a switch device.
Figure 16:
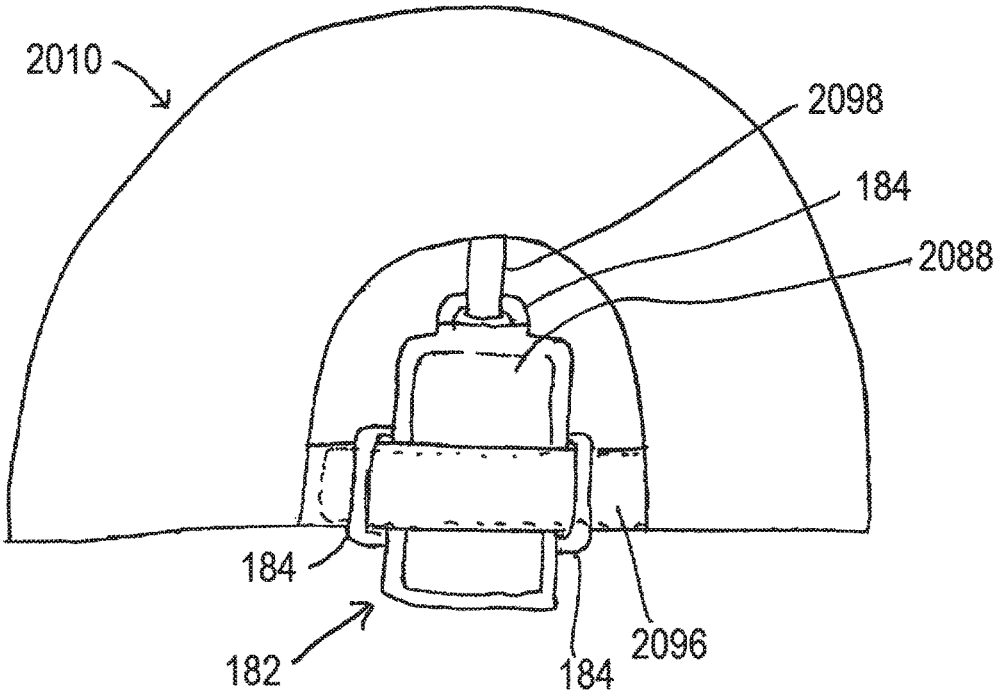
FIG. 16 is a rear elevational view of a hat having the battery pack of FIGS. 14 and 15 mounted to a rear portion of the hat.

An alternative power source housing 182 for the electrical components described herein is shown in FIGS. 14 and 15. The power source 50 received in the brim 14 as described above, is restricted in that the size thereof is limited by how much weight can be mounted to the brim 14, as well as having to consider the size of structure being mounted to the brim 14 and its impact on the aesthetics of the hat 10. In contrast, the power source housing 182 can be mounted to a rear portion of a hat as described in U.S. application Ser. No. 13/725,558, filed on Dec. 21, 2012, which is hereby incorporated by reference herein in its entirety. Specifically, the power source housing 182 includes securing portions or handles 184 on three sides 186 thereof. So configured, hat 10 can then include three corresponding loops of material or a loop of material secured to the top handle 184 and a strip of material extending over the power source housing 182 through the side handles 184, such as an adjustment strap of a hat or the like. Additional mounting details and structure are disclosed in the '558 application, which is briefly described below and shown in FIG. 16.

More specifically, the power source housing 182 is mounted to the rear portion of a hat 2010 by three points of securement therebetween in a manner similar to that described in the '558 application. More particularly, an adjustable strap 2096 can pass through the spaces or openings between the side handles 184 and an outer surface of the housing sidewall to secure the power source housing 182 to the rear portion of the hat 2010 at two of the three points of securement. The two side handles 184 thus form the first and second points of securement with the rear portion of the hat 2010. The strap 2096 can extend laterally across an outer major surface 2088 of the housing 182, with the housing 182 oriented so that the outer major surface 2088 is the rearward surface.

Furthermore, the power source housing 182 can be oriented so that the top handle 184 is in the form of an upper securing member disposed at the top of the power source housing 182. The third point of securement is formed between the upper securing member 184 and a loop or upper strap portion 2098. The upper strap portion 2098 is located at the rear portion of the hat 2010, generally above and adjacent to the strap 2096 extending downwardly and transverse to the laterally extending strap 2096. The upper strap 2098 can be received through the opening or space between the top handle 184 and an outer surface of the corresponding housing sidewall portion.

The upper strap portion 2098 can be irremovably mounted to the upper securing member 184 in the form of a closed loop connection therebetween. Thus, while the strap 2096 can be easily adjusted within or removed from the openings between the side handles 184 and the corresponding sidewalls to adjust the tightness of the hat 2010, the upper strap portion 2098 remains relatively secure, permitting rotation adjustment of the closed loop connection but substantially preventing removal of the upper strap portion 2098 from the upper securing member 184. Therefore, if the strap 2096 is removed, the power source housing 182 stays coupled to the hat 2010 via the upper strap portion 2098 to ensure that the housing 182 is not misplaced or that it does not drop to the ground from the hat 2010. However, the upper securing member 184 could also be mounted to the upper strap portion 2098 in a manner permitting easy detachment if desired, such as by using a looped connection capable of repeated opening and closing, or providing a break in the upper securing member 184. The upper strap portion 2098 is preferably made from a flexible fabric material; however, other materials can also be used.

Turning back to the structure shown in FIGS. 14 and 15, the power source housing 182 includes a power source compartment 184, which can be sized and configured to receive one or more power sources 186 therein, which are preferably rechargeable, such as permanently mounted batteries or replaceable batteries, as desired. In the form of a permanently mounted battery, the housing 182 can be sealed shut to provide water tight protection. Alternatively, in the form of replaceable batteries, the power source compartment 184 can include a removable or movable cover 188 that is configured to be releasably secured to the housing 182 using suitable structure 190, such as snap-fit, tongue and groove, or the like.

The power source housing 182 can further receive a switch device 192 therein. In the illustrated form, the switch device 192 is a push button switch device having a switch base 194 and a switch actuator 196 that projects away from the switch base 194 and is shiftable with respect thereto. As such, the switch base 194 can be disposed within the housing 182 and the housing 182 includes an opening 198 sized to receive the actuator 196 extending therethrough. The actuator 196 is then accessible to a user of the electronic components coupled to the power source housing 182, as described in further detail below. When coupled to the hat 10, and specifically the light sources 46 thereof, the switch device 192 can be used to shift the light sources 46 between on and off configurations. Alternatively, the switch device 192 can be a master control that functions to control power distribution from the power sources 186. For example, a user can actuate the switch device 192 to an off configuration when electrical devices coupled thereto are not in use. This would prevent the switch device 52 coupled to the light sources 46 from being able to energize the light sources 46.

In order to protect against inadvertent actuation, the housing 182 can include a recessed well 200 having the opening 198 centrally therein. The activation point of the actuator 196, i.e., the point at which the device 192 is switched between on and off configurations, can then correspond to a location where an upper surface 202 of the actuator 196 is shifted from being above to below a raised surface 204 of the housing 182 extending around the recess 200 and the actuator 196 therein. With this configuration, the switch device 192 cannot be actuated by pressing the housing 182 against a flat surface, such as could easily happen if the housing 182 were left on a table, for example. Instead, a user has to at least partially press the actuator 196 down into the recess 200.

The power source housing 182 can further include a pair of ports 206 mounted therein and accessible through openings 208. The ports 206 can be utilized to receive plugs 210 therein to connect the power source housing 182 with other electrical components. The ports 206 can each further include a corresponding cover 211 that is configured to be connected to the port 206 to cover the opening 208 thereby protecting the port 206 from foreign debris and the like. The cover 211 can advantageously be attached to the housing 182 with a flexible tether 213 so that the cover 211 is not lost while not in use. A first one of the ports 206 can be utilized to connect the power source housing to the light sources 46, a camera device, such as that disclosed in PCT/US12/71469, filed Dec. 21, 2012, which is hereby incorporated by reference herein in its entirety, or the like. With such a configuration, rather than a permanently connected wire electrically coupling the light sources 46 to the power source, the light sources 46 instead can be electrically coupled to the power source 186 using a wire having a plug 210 on the end thereof that is configured to be inserted into the port 206. This allows for easier manufacturing of the hat because the light sources 46 can be coupled to the power source 186 after being mounted to the hat. The other of the ports 206 can be utilized, as discussed above, to charge or power devices not mounted to the hat 10. For example, a portable electronic device 212, such as a phone, tablet, or the like, can plug into the port and receive power from the rechargeable batteries 186. This is particularly advantageous in areas without a consistent electrical supply. The rechargeable configuration of the power source 186 for the hat 10 can be utilized to power and recharge devices in addition to the light sources 46 thereof.

Those skilled in the art will recognize that a wide variety of modifications, alterations, and combinations can be made with respect to the above described embodiments without departing from the spirit and scope of the invention, and that such modifications, alterations, and combinations, are to be viewed as being within the scope of the invention.

The invention claimed is:

1. Headgear comprising:

a head-fitting portion for being disposed on a user's head;

a brim portion extending from a forward lower edge of the head-fitting portion along a brim axis, the brim portion having upper and lower major surfaces of respective upper and lower fabric portions that cover a brim insert of the brim portion;

at least one solar panel disposed on the brim portion to be engaged with the upper major surface of the brim portion;

a housing including upper and lower housing portions mounted to the upper and lower major surfaces, respectively;

threaded fasteners extending through the brim portion to mount the upper and lower housing portions to the brim portion, connect the upper and lower housing portion together, and compress the brim portion between the connected upper and lower housing portions;

a rigid frame member of the upper housing portion mounted to the brim portion and having a central window opening aligned with the solar panel;

a transparent cover member having a central raised portion, the cover member mounted to the brim portion such that the central raised portion extends into the central window opening of the frame member to cover the at least one solar panel aligned with the central window opening of the frame member to receive light energy;

a flange of the transparent cover member that is lowered relative to the central raised portion and extends outwardly from the central raised portion;

an inner surface of the rigid frame member extending about the central window opening with the flange of the transparent cover member captured between the inner surface of the rigid frame member and the upper major surface of the brim portion;

a rechargeable power source mounted to one of the head-fitting portion or the brim portion and electrically connected to the at least one solar panel to receive recharging power from the at least one solar panel; and at least one light source mounted in the lower housing portion to be disposed under the brim portion so as to project light forwardly from the brim portion and electrically coupled to the rechargeable power source to receive power from the rechargeable power source.

2. The headgear of claim 1 including a power source housing in which the rechargeable power source is mounted to the head-fitting portion.

3. The headgear of claim 2 wherein the power source housing includes one or more ports mounted thereto and electrically connected to the rechargeable power source, the ports configured to receive plugs therein to provide power to external devices.

4. The headgear of claim 3 wherein the light source is electrically coupled to a plug, and the plug is configured to be coupled to one of the ports to electrically couple the rechargeable power source to the light source.

5. The headgear of claim 4 wherein the power source housing includes a switch device mounted thereto configured to control power distributed from the rechargeable power source.

6. The headgear of claim 5 wherein the power source housing includes a recess in an outer surface thereof, the recess having an opening to an interior of the power source housing; the switch device includes a switch base and a switch actuator extending outwardly from the switch base, the switch device being mounted to the power source housing so that the switch base is disposed in the interior thereof with the switch actuator projecting through the opening into the recess; and the recess is sized so that an actuation point of the switch device corresponds with an upper surface of the switch actuator being depressed into the recess to minimize inadvertent actuation of the switch device.

7. The headgear of claim 5 further comprising a second switch device mounted to the brim portion for controlling operation of the light source.

8. The headgear of claim 1 wherein the at least one solar panel comprises a plurality of solar panels; and the upper and lower major surfaces of the brim portion generally conform to a footprint of the plurality of solar panels so that an outboard edge of the brim portion has an irregular shape.

* * * * *